US005970276A

United States Patent [19]

Kato

[11] Patent Number: 5,970,276

[45] Date of Patent: Oct. 19, 1999

[54] IMAGE FORMING APPARATUS AND DEVELOPER AGING METHOD

[75] Inventor: Shinji Kato, Kawasaki, Japan

[73] Assignee: Ricoh Company, Ltd., Tokyo, Japan

[21] Appl. No.: 08/896,444

[22] Filed: Jul. 18, 1997

[30] Foreign Application Priority Data

Jul. 19, 1996 [JP] Japan ..... 8-191171
May 7, 1997 [JP] Japan ..... 9-117142

[51] Int. Cl.[6] ..... G03G 15/08; G03G 15/00

[52] U.S. Cl. ..... 399/29; 399/49; 399/53

[58] Field of Search ..... 399/44, 46, 48, 399/49, 53, 58, 60, 30, 42, 223, 224

[56] References Cited

U.S. PATENT DOCUMENTS 5,402,209 3/1995 Itoyama et al. ..... 399/46
5,475,476 12/1995 Murai et al. ..... 399/29
5,552,877 9/1996 Ishikawa et al. .
5,565,973 10/1996 Fujishiro et al. .
5,617,198 4/1997 Ishikawa et alk. .
5,646,721 7/1997 Sugihara et al. .

FOREIGN PATENT DOCUMENTS 60-84559 5/1985 Japan .

*Primary Examiner*—Joan Pendegrass
*Attorney, Agent, or Firm*—Oblon, Spivak, McClelland, Maier & Neustadt, P.C.

[57] ABSTRACT

An image forming apparatus and a method of aging a developer stored in the apparatus are disclosed. The developer is adequately aged in accordance with the initial characteristic of the developer and environmental conditions. As a result, the developer automatically achieves a desired developing characteristic in a short period of time. An image of high quality, i.e., free from background contamination and local omission can be stably produced even just after the aging. In addition, toner is prevented from flying about. Even erroneous sensing by an optical sensor can be obviated.

113 Claims, 24 Drawing Sheets

| |
|---|
| Fig. 10A |
| Fig. 10B |
| Fig. 10C |

Fig. 15

57

| NO | Vmax | VD | VB | VL |
|---|---|---|---|---|
| 1 | 160 | -400 | -260 | -110 |
| 2 | 180 | -429 | -286 | -118 |
| 3 | 200 | -457 | -311 | -126 |
| 4 | 220 | -486 | -337 | -133 |
| 5 | 240 | -514 | -363 | -141 |
| ----- | ----- | ----- | ----- | ------ |
| 16 | 460 | -829 | -646 | -226 |
| 17 | 480 | -857 | -671 | -234 |
| 18 | 500 | -886 | -697 | -241 |
| 19 | 520 | -914 | -723 | -249 |
| 20 | 540 | -943 | -749 | -257 |

Fig. 16

| | 10°C | 20°C | 23°C | 30°C | 32°C |
|---|---|---|---|---|---|
| 10% | 0.94 | 1.73 | 2.06 | 3.03 | 3.38 |
| 15% | 1.41 | 2.59 | 3.09 | 4.55 | 5.07 |
| 20% | 1.88 | 3.46 | 4.12 | 6.02 | 6.76 |
| 25% | 2.36 | 4.33 | 5.15 | 7.58 | 8.45 |
| 30% | 2.82 | 5.19 | 6.18 | 9.09 | 10.14 |
| 35% | 3.29 | 6.06 | 7.21 | 10.61 | 11.83 |
| 40% | 3.76 | 6.92 | 8.24 | 12.12 | 13.52 |
| 45% | 4.23 | 7.79 | 9.27 | 13.64 | 15.21 |
| 50% | 4.70 | 8.65 | 10.30 | 15.15 | 16.90 |
| 55% | 5.17 | 9.52 | 11.33 | 16.67 | 18.59 |
| 60% | 5.64 | 10.38 | 12.36 | 18.18 | 20.28 |
| 65% | 6.11 | 11.25 | 13.39 | 19.70 | 21.97 |
| 70% | 6.58 | 12.11 | 14.42 | 21.21 | 23.66 |
| 75% | 7.05 | 12.98 | 15.45 | 22.73 | 25.35 |
| 80% | 7.52 | 13.84 | 16.48 | 24.24 | 27.04 |
| 90% | 8.46 | 15.57 | 18.54 | 27.27 | 30.42 |

LOW HUMIDITY RANGE

NORMAL HUMIDITY RANGE

HIGH HUMIDITY RANGE

| Fig. 18A |
| --- |
| Fig. 18B |

Fig. 19

| | |
|---|---|
| HIGH TEMPERATURE, HIGH HUMIDITY | 0.8 < Ma max < 1.3 |
| LOW TEMPERATURE, LOW HUMIDITY | 0.7 < Ma max < 1.2 |
| OTHERS | 0.8 < Ma max < 1.2 |

| |
|---|
| Fig. 20A |
| Fig. 20B |
| Fig. 20C |

IMAGE FORMING APPARATUS AND DEVELOPER AGING METHOD

BACKGROUND OF THE INVENTION

The present invention relates to a copier, laser printer, facsimile apparatus or similar image forming apparatus and, more particularly, to a developer aging method for a developing device included in such an image forming apparatus.

It is a common practice with an image forming apparatus to age a developer at the time of installation of the apparatus at the user's station or at the time of periodic maintenance of the apparatus. Aging is effected via the agitation of a developer initially introduced into the apparatus or the replenishment or consumption of toner. Aging provides the developer with a desired developing characteristic and thereby insures high image quality.

A two-ingredient type developer applicable to an image forming apparatus consists of toner and carrier. Generally, the amount of charge deposited on this type of developer varies, depending on the environment at the time of preparation, the duration of an unused state, and so forth. Specifically, even when an image is output under the same conditions as at the time of the initial introduction of the developer, image density changes with a change in the kind of the developer and a change in the environment of use. As a result, image density is apt to be excessively low, or in the worst case a locally omitted image or similar defective image and carrier deposition occur.

To solve the above problem, a developing device may be continuously driven for a preselected period of time in order to agitate the developer introduced therein. Alternatively, a paper may actually be conveyed through the apparatus in the same manner as during usual image formation. However, the conventional agitation scheme simply agitates the developer and cannot perform accurate adjustment implementing a desired developing characteristic. Toner replenishment to occur after this kind of aging is apt to cause the toner to fly about and even bring about defective images, image density variation, and other troubles. These troubles are particularly serious when the charging characteristic of the toner existing in the initial developer and that of fresh toner to be replenished are different from each other. The scheme actually conveying a paper, as stated above, wastes papers. Moreover, because this kind of scheme relies on usual toner replenishment control, a system of the type detecting the amount of toner deposited on a photoconductive element with, e.g., an optical sensor for the replenishment of toner will replenish toner continuously as long as the developing ability of the developer is low. This prevents the charge of the toner from being sufficiently increased and causes the toner to fly about and contaminate the background of the photoconductive element. In addition, if the developing ability of the initial developer is high, a great amount of toner is deposited on the photoconductive element and causes the aging to complete without any fresh toner replenished due to the inherent control. As a result, when toner of different charging characteristic is replenished from a cartridge later, it is apt to vary the image density or flies about itself.

Furthermore, assume a system of the type detecting a toner end condition with an optical sensor when the amount of toner deposition on a photoconductive element decreases. Then, the system is likely to detect a toner end condition despite that toner is present in a cartridge, if adequate aging is not executed.

SUMMARY OF THE INVENTION

It is therefore an object of the present invention to provide an image forming apparatus capable of executing adequate developer aging in accordance with the initial characteristic of a developer and environmental conditions to thereby automatically realize a desired developing characteristic in a short period of time and insure stable image quality even just after the aging, and a method of aging the developer.

In accordance with the present invention, an image forming apparatus for forming a toner image on a photoconductive element with a charger, an exposing device and a developing unit, and transferring the toner image to a recording medium includes a calculating section for calculating a state amount relating to the developing characteristic of the developing unit acting on the image carrier. An aging executing section executes at least one of agitation of a developer stored in the developing unit, replenishment of toner to the developing unit and consumption of toner by the developing unit. A controller controls the aging executing section such that the state amount calculated by the calculating section coincides with a desired state amount.

Also, in accordace with the present invention, an automatic developer aging method for an image forming apparatus has the steps of forming a reference latent image pattern on an image carrier and measuring the surface potential of the reference latent image pattern, developing the reference latent image pattern by toner and measuring the amount of the toner deposited on the reference latent image pattern, calculating, based on the surface potential and amount of toner, an instantaneous state amount relating to a developing characteristic, and executing aging of a developer on the basis of the state amount such that a desired developing characteristic is set up.

BRIEF DESCRIPTION OF THE DRAWINGS

The above and other objects, features and advantages of the present invention will become apparent from the following detailed description taken with the accompanying drawings in which:

FIG. 15 shows the contents of a table;

FIG. 16 shows an absolute humidity conversion table;

FIG. 19 is a table listing a relation between the maximum amount of toner deposition and the temperature and humidity.

DESCRIPTION OF THE PREFERRED EMBODIMENTS

Figure 1:
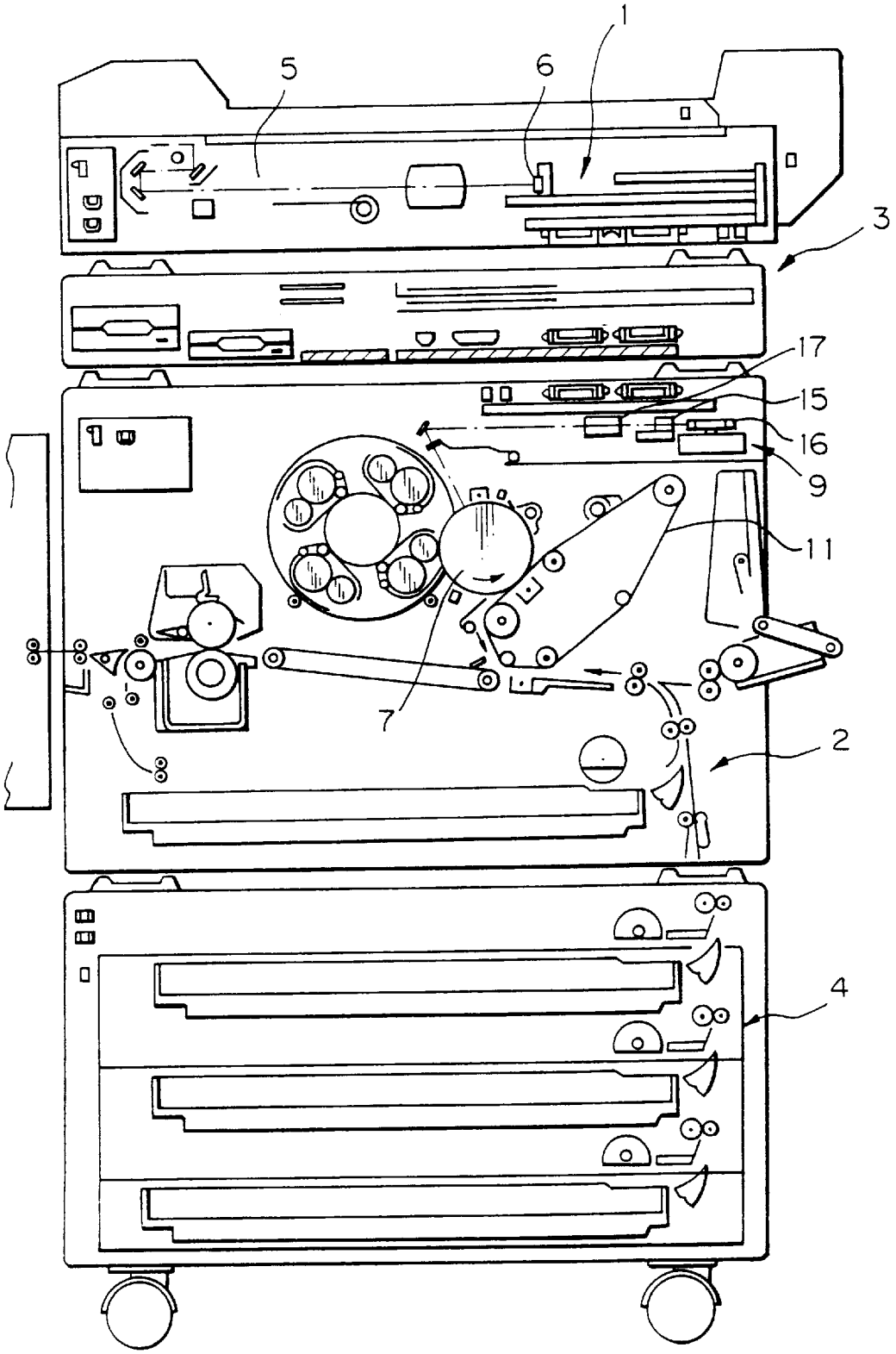
FIG. 1 shows an image forming apparatus embodying the present invention and implemented as a digital color copier.

Referring to FIG. 1 of the drawings, an image forming apparatus with which a developer aging method embodying the present invention is practicable is shown and implemented as a digital color copier by way of example. As shown, the copier is generally made up of a scanner module 1, a system control module 3, a printer module 2 and a paper cassette module 4 arranged in a stack configuration. The copier has a facsimile function and a printer function in addition to a copier function.

The scanner module I separates color image data representative of a document into, e.g., R (red), G (green) and B (blue) primary colors and reads them color by color while transforming them to corresponding electric image signals. As a result, the scanner module 1 outputs Bk (black), C (cyan), M (magenta) and Y (yellow) color image data. To implement this function, the scanner module 1 is provided with a conventional structure including scanning optics 5 and a CCD (Charge Coupled Device) line sensor or similar color image sensor 6 which includes RGB color separating means.

Figure 2:
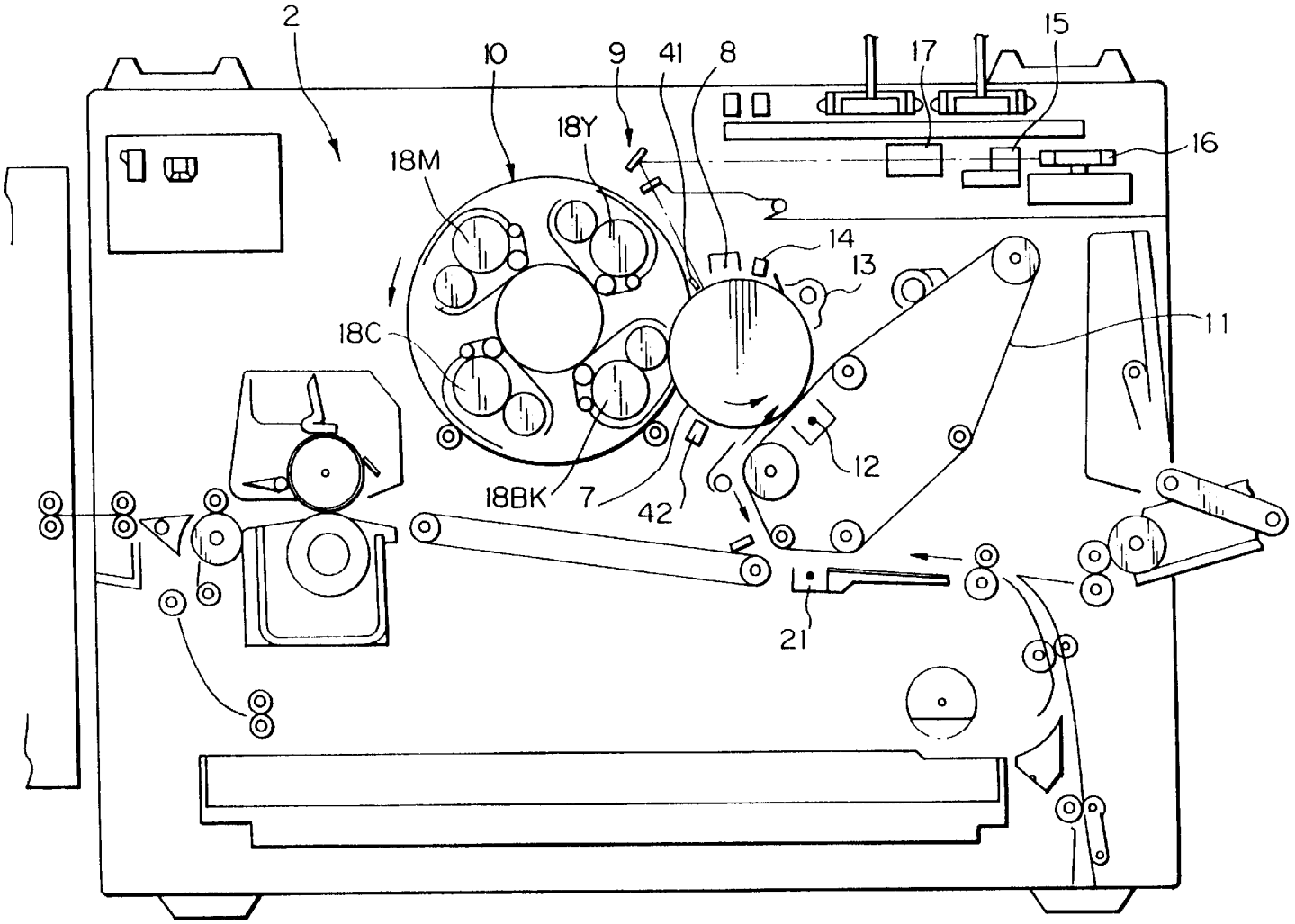
FIG. 2 shows a printer module included in the embodiment of FIG. 1.

The printer module 2 is implemented as a full-color printer using an electrophotographic system. As shown in FIG. 2, the printer module 2 includes an image carrier in the form of a photoconductive drum 7 rotatable in the direction indicated by an arrow. A charger 8, an exposing section using an optical writing unit 9, a revolver type developing device or developing means 10, an image transfer unit 12, a drum cleaning unit 13 and a discharge lamp 14 are sequentially arranged around the drum 7 in the direction of rotation of the drum 7. The image transfer unit 12 faces the drum 7 with the intermediary of an intermediate transfer belt 11. Also arranged around the drum 7 are a potential sensor 41 and an optical sensor 42. The optical writing unit 9 includes laser beam issuing means 15, a polygonal mirror 16, and an fθ lens 17. When the scanner module 2 sends the color image data to the writing unit 9, the writing unit 9 transforms them to an optical signal and optically exposes the drum 7 therewith so as to form a latent image electrostatically on the drum 7.

The developing device, or revolver as referred to hereinafter, 10 has a Bk developing section 18Bk, a C developing section 18C, an M developing section 18M, a Y developing section 18Y, and a drive arrangement, not shown, for causing the developing sections 18Bk-18Y to rotate integrally in the direction indicated by an arrow in FIG. 2, i.e., counterclockwise. The developing sections 18Bk-18Y each includes a developing sleeve and a paddle. The developing sleeve rotates with a developer deposited thereon contacting 5 the surface of the drum 7, thereby developing the latent image formed on the drum 7. The paddle scoops up the developer while agitating it. A temperature sensor and a humidity sensor, not shown, are located at one side of each of the developing sections 18Bk-18Y.

In a stand-by state, the revolver 10 is held in a halt with the Bk developing section 18Bk facing the drum 7. On the start of a copying operation, the scanner module 1 starts reading Bk image data at a preselected timing while the writing unit 9 starts forming a latent image based on the Bk image data. Let the latent image based on the Bk image data be referred to as a Bk latent image. This is also true with C, M and Y. Before the leading edge of the Bk latent image arrives at a developing position where the Bk developing unit 18Bk is located, the developing sleeve included in the developing section 18Bk starts rotating in order to develop the Bk latent image from its leading edge. As soon as the trailing edge of the Bk latent image moves away from the developing position, the revolver 10 revolves to bring the next developing section to the developing position. This is completed at least before the leading edge of the next latent image arrives at the developing position.

On the start of an image forming cycle, the drum 7 is rotated counterclockwise, as indicated by an arrow. At the same time, the intermediate transfer belt 11 is caused to rotate clockwise by a drive motor, not shown. While the belt 11 is in rotation, a Bk image, C image, M image and Y image are sequentially formed. The Bk, C, M and Y images are sequentially transferred from the drum 7 to the belt 11 one upon the other, forming a composite toner image.

First, the Bk image is formed by the following specific procedure. The charger 8 uniformly charges the surface of the drum 7 to about −700 V by corona discharge. The laser beam issuing means 15 exposes the charged surface of the drum 7 by raster scanning based on a Bk signal. As a result, the charge deposited on the portions of the drum 7 exposed by the raster scanning is dissipated in proportion to the amount of the incident beam, forming a Bk latent image electrostatically on the drum 7.

Each toner stored in the revolver 10 is charged to the negative polarity by being agitated together with a ferrite carrier. Power source means, not shown, biases the developing sleeve of the Bk developing unit 18Bk to a potential consisting of a DC potential and an AC potential superposed on each other relative to a metallic base layer included in the drum 7. Consequently, Bk toner is deposited only on the portions of the drum 7 where the charge is absent, i.e., the exposed portions, transforming the Bk latent image to a Bk toner image.

The intermediate transfer belt 11 is passed over a plurality of rollers and rotated clockwise, as viewed in FIG. 2. The belt 11 is formed of, e.g., ehtylenetetrafluoroethylene (ETFE) and has a medium electric resistance in terms of surface resistance, i.e., $10^8$ Ω/cm$^2$ to $10^{10}$ Ω/cm$^2$.

The belt 11 is driven in contact with and at the same speed as the drum 7. The image transfer unit, or belt transfer unit as referred to hereinafter, 12 transfers the Bk toner image from the drum 7 to the belt 11 by corona discharge. The transfer of a toner image from the drum 7 to the belt 11 will be referred to as belt transfer for simplicity. The drum cleaning unit 13 removes the toner remaining on the drum 7 after the belt transfer and thereby prepares the drum 7 for the formation of the next latent image. The toner removed by the drum cleaning unit 13 is collected in a waste toner tank via a tubing, although not shown specifically. The composite or quadracolor color image formed on the belt 11 in accurate register is transferred to a paper or similar recording medium by a corona discharger, or paper transfer unit as referred to hereinafter, 21. The paper transfer unit 21 applies an AC+DC component or a DC component for the above purpose.

After the above Bk process, the scanner module 1 starts reading C image data at a preselected timing. The writing unit forms a C latent image based on the C image data on the drum 7. After the trailing edge of the Bk latent image has moved away from the developing position, but before the leading edge of the C latent image arrives at the developing position, the revolver 10 rotates to bring the C developing section 18C to the developing position. The C developing section 18C develops the C latent image with C toner. As soon as the trailing edge of the C latent image moves away from the developing position, the revolver 10 again rotates to bring the M developing section 18M to the developing position. This is also completed before the leading edge of an M latent image arrives at the developing position. An M process and a Y process will not be described specifically because they are identical with the Bk and C processes as to the generation of image data, the formation of a latent image, and the operation of the developing unit.

A paper is fed from the paper cassette module 4 to the paper transfer unit 21 at such a timing that the leading edge of the paper meets the leading edge of the quadracolor toner image being conveyed by the intermediate transfer belt 11. When the paper moves over the paper transfer unit 21 together with the toner image carried on the belt 11, the paper transfer unit 21 connected to a positive potential charges the paper by corona discharge. As a result, the toner image is transferred from the belt 11 to the paper. A discharger, not shown, is located at the left of the paper transfer unit, as viewed in FIG. 2. This discharger discharges the paper by AC+DC corona so as to separate the paper from the belt 11. The paper separated from the belt 121 is conveyed toward a fixing unit.

The drum cleaning unit 13 for cleaning the drum 7 after the belt transfer is implemented by a brush roller or a rubber blade by way of example. The discharge lamp 14 uniformly discharges the surface of the drum 7 cleaned by the cleaning unit 13. Likewise, after the paper transfer, the belt 11 has its surface cleaned by a belt cleaning unit.

In a repeat copy mode, the operation of the scanner module 1 and the image formation on the drum 1 are effected such that after the fourth color (Y) of the first composite image, the first color (Bk) of the second composite image is dealt with at a preselected timing. After the transfer of the first composite image from the belt 11 to the paper, the first or Bk toner image for the second composite image is transferred to the area of the belt 11 having been cleaned by the belt cleaning unit. This is followed by the procedure described in relation to the first composite image.

By the copy mode described above, a quadracolor toner image is formed on a paper of, e.g., size A4 fed in a horizontally long position. In a tricolor or a bicolor copy mode, the above procedure will be repeated a number of times corresponding to the number of designated colors and the desired number of copies. In a monocolor mode, the developing unit of the revolver 10 assigned to a desired color will be continuously held at the developing position while the belt 11 will be continuously cleaned by the belt cleaning unit.

Figure 3:
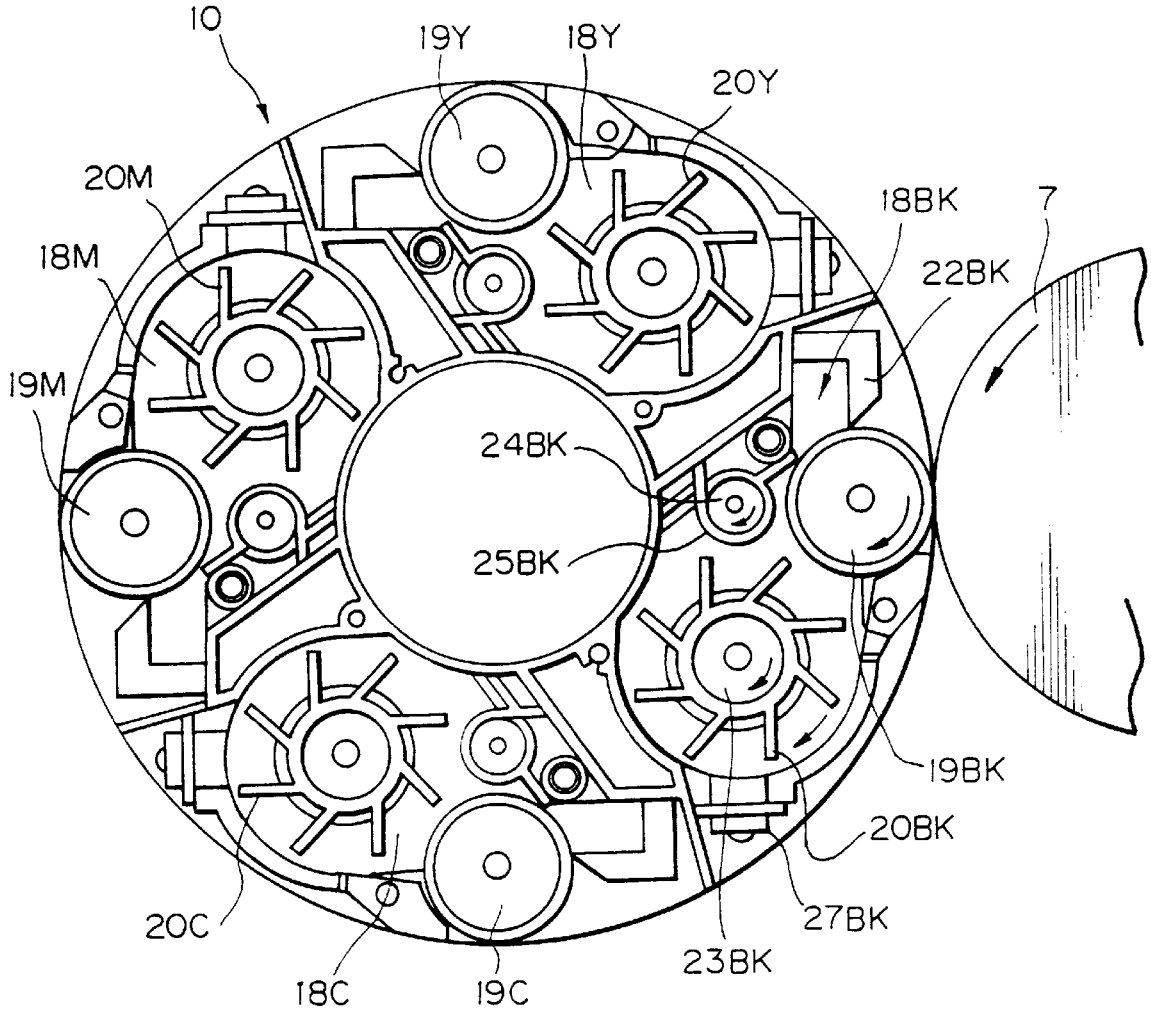
FIG. 3 is a section showing a developing device also included in the embodiment of FIG. 1.
Figure 4:
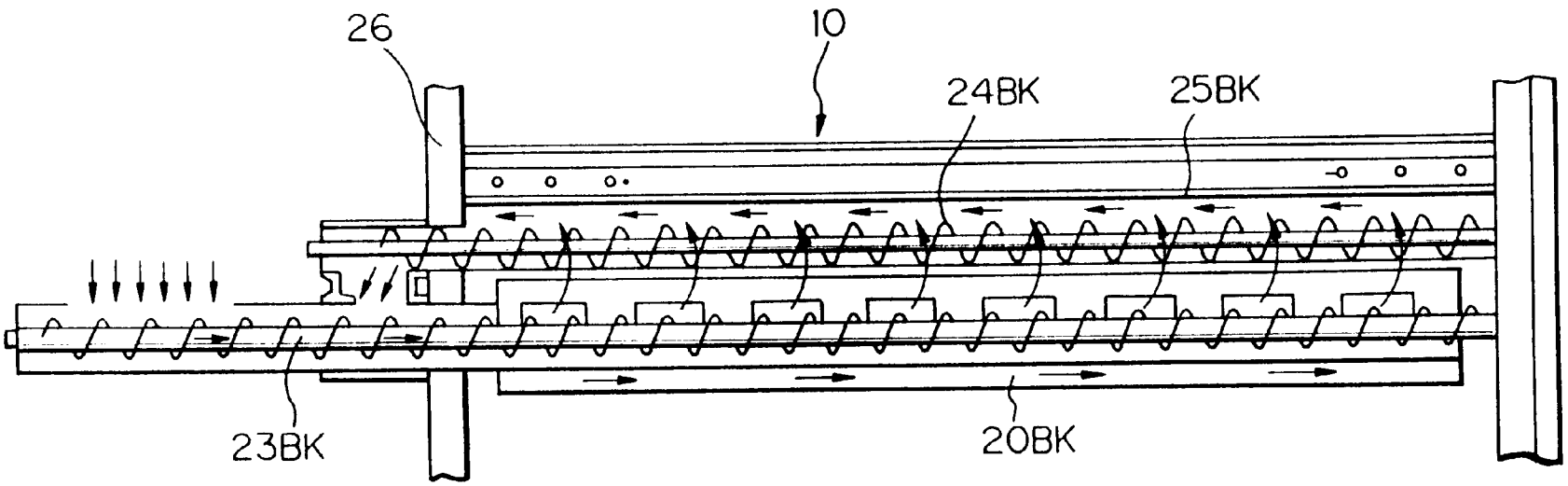
FIG. 4 is a vertically sectioned side elevation showing a part of the developing device shown in FIG. 3.

FIG. 3 shows the revolver 10 with the Bk developing section 18Bk facing the drum 7 at the developing position. As shown, the developing sections 18Bk-18Y are arranged around the center of rotation of the revolver 10. Because all the developing sections 18Bk-18Y are identical in configuration, let the following description concentrate on the Bk developing section 18Bk by way of example. The Bk developing section 18Bk includes a developing roller 19Bk having a magnet roller, not shown, thereinside. A doctor 22Bk regulates the amount of a Bk developer to be conveyed by the developing roller 19Bk to the drum 7. The developing unit 18Bk further includes a paddle 20Bk for agitating the developer, a screw paddle 23Bk, a screw 24Bk, and a screw case 25Bk. As shown in FIG. 4, the developer is circulated while being so agitated as to have a uniform toner content.

Specifically, the developer in the screw case 25Bk is conveyed by the screw 24Bk from the rear to the front, as viewed in FIG. 3, and then dropped onto the screw paddle 23Bk via a front side wall. The screw paddle 23Bk conveys the developer from the front to the rear, as viewed in FIG. 3, via the front side wall. The developing roller 19Bk scoops up the developer from the paddle and conveys it to the developing position. The doctor 22Bk removes the excessive part of the developer from the roller 19Bk and causes it to drop into the screw case 25Bk. In this manner, the developer is circulated in the developing section 18Bk.

Figure 5:
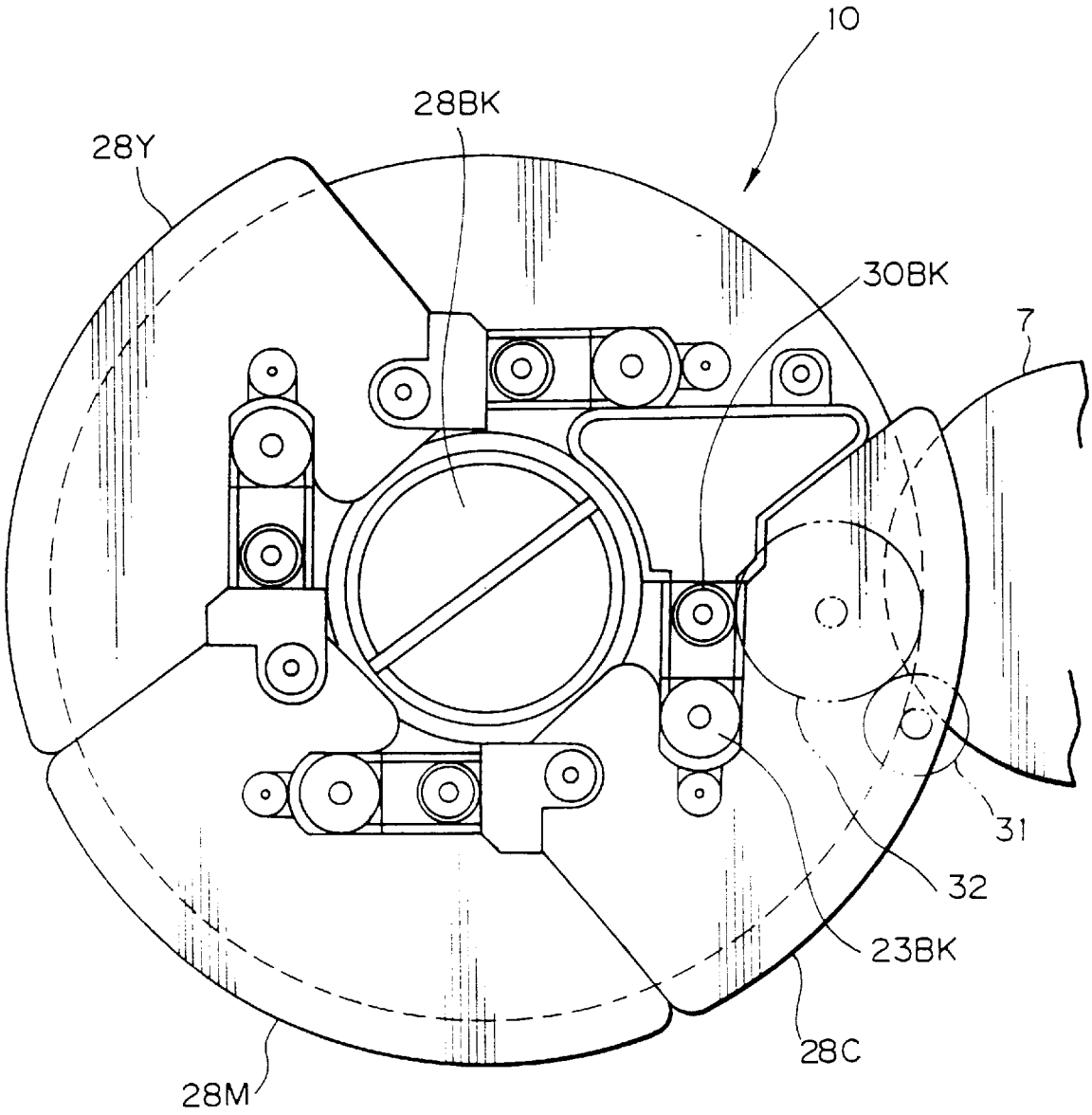
FIG. 5 shows a toner replenishing section further included in the embodiment of FIG. 1.

The replenishment of toner will be described hereinafter. As shown in FIG. 5, toner cartridges 28Bk, 28C, 28M and 28Y each storing toner of particular color are located at a toner replenishing section adjoining the developing units 18Bk-18Y. The Bk cartridge 28Bk is positioned at the center of the revolver 10 because Bk toner is used more frequency than the others. The Bk cartridge 28BK is elongage in the direction perpendicular to the sheet surface of FIG. 5 and replenishes fresh BK toner to a Bk toner hopper when the revolver 10 rotates. A motor for replenishment 31 is interposed between the Bk toner hopper and the screw paddle 23Bk in order to drive a replenish roller 30Bk via a roller 32 while being regulated by the roller 30Bk. The revolver 10 includes a lid 27Bk, FIG. 3, for allowing the developer to be introduced or collected. A toner end sensor, not shown, is mounted on each toner cartridge so as to detect a toner end condition when the cartridge runs out of toner.

To replenish, e.g., the Bk toner, the motor 31 is energized to rotate the replenish roller 30Bk. As a result, the toner in the Bk toner cartridge 28Bk or the associated toner hopper is caused to drop onto the screw paddle 23Bk. The screw paddle 23Bk conveys the toner while in rotation. The toner is therefore fed into the Bk developing section 18Bk via the front side wall while being mixed with the developer at the position where it drops onto the screw paddle 23Bk.

Figure 6:
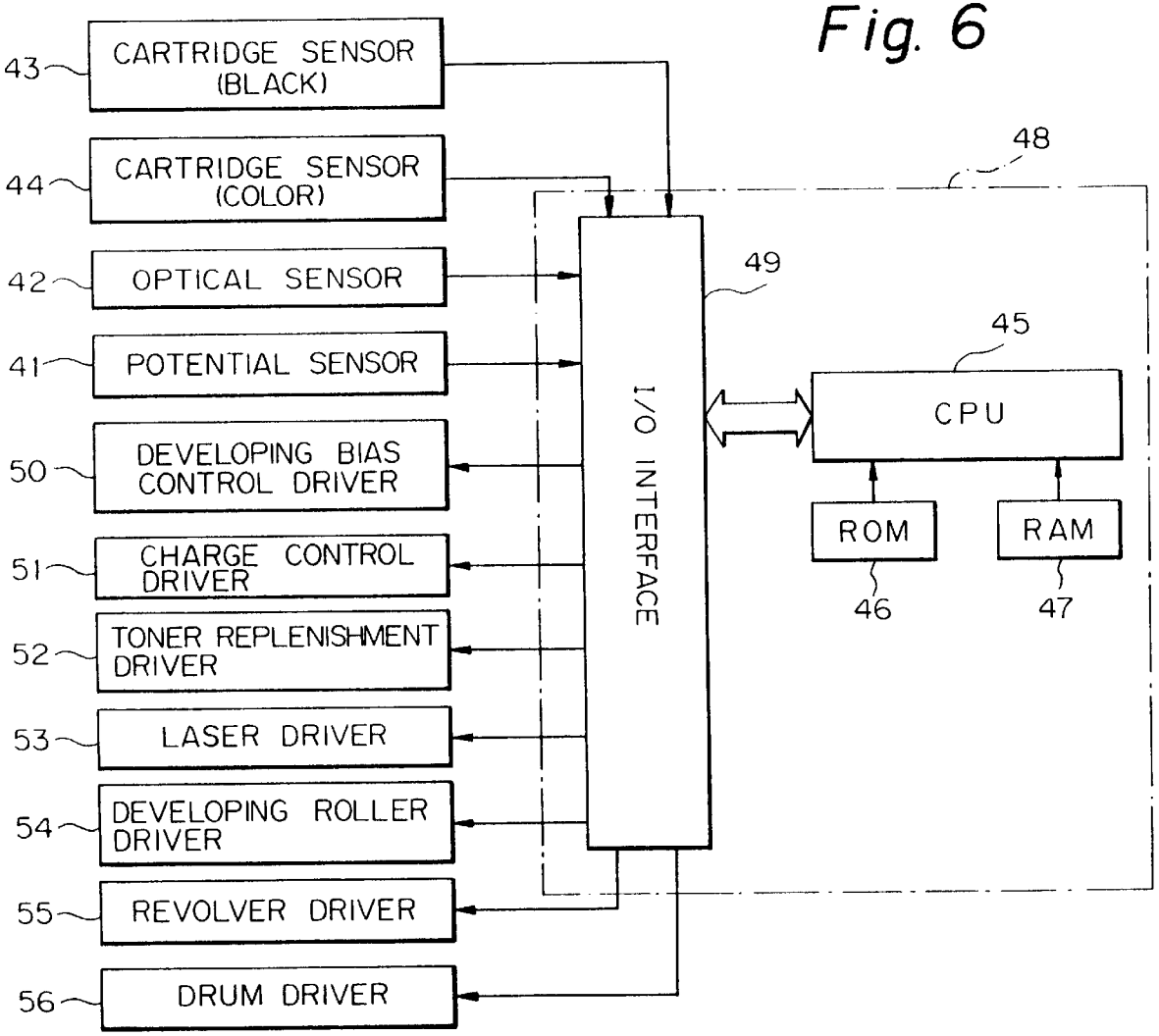
FIG. 6 is a block diagram schematically showing an electric control system particular to the embodiment of FIG. 1.

FIG. 6 shows an electric control system particular to the illustrative embodiment. As shown, the system control module 3, FIG. 1, includes a CPU (Central Processing Unit) 45, ROM (Read Only Memory) 46 storing a basic program and basic data for executing it, and a RAM (Random Access Memory) 47 for storing various kinds of data. The control module, or controller as referred to hereinafter, 48 controls the scanner module 1, printer module 2, and paper cassette module 4. Various units are connected to the CPU 45 via an I/O (Input/Output) interface 49. Specifically, the potential sensor 41, the optical sensor 42, an optical sensor 43 responsive to the Bk toner cartridge and optical sensors 44 responsive to the color toner cartridges are connected to the input side of the I/O interface 49. Connected to the output side of the I/O interface 49 are a developing bias control driver 50, a charge control driver 51, a toner replenishment control 52, a laser driver 53, a developing roller driver 54, a revolver driver, and a drum driver 56.

The controller 48 controls toner replenishment, as follows. First, a reference toner image is formed on the drum 7. The optical sensor 42 senses the amount of a reflection from the reference toner image. The controller 48 calculates, based on the output of the optical sensor 42, the amount of toner deposited on the drum 7 (for a unit area). The controller 48 determines an amount of toner to be replenished on the basis of the amount of toner deposition and the area of the toner image (calculated in terms of the integrated amount of writing by a laser diode). Then, the controller 48 drives the toner replenishment control 52 in order to replenish the determined amount of fresh toner.

The amount of toner deposited on the reference toner image will be described specifically hereinafter. In the illustrative embodiment, the following different kinds of patterns are selectively used for determining the amount of toner deposition. When a power switch provided on the copier is turned on, i.e., when the temperature sensed by a fixing temperature sensor is lower than 100° C., or every time a preselected number of copies are produced, the controller 48 executes process control self-checking (i.e. at the time of potential control). A twelve-tone pattern is assigned to such process control self-checking. During usual copying operation, a halftone pattern or a solid pattern for toner replenishment control is formed at the trailing edge outside of an image area every time a single image is formed. Another twelve-tone pattern, and a halftone pattern or a solid pattern and an internal pattern for toner replenishment control are assigned to the aging of a developer.

Figure 7:
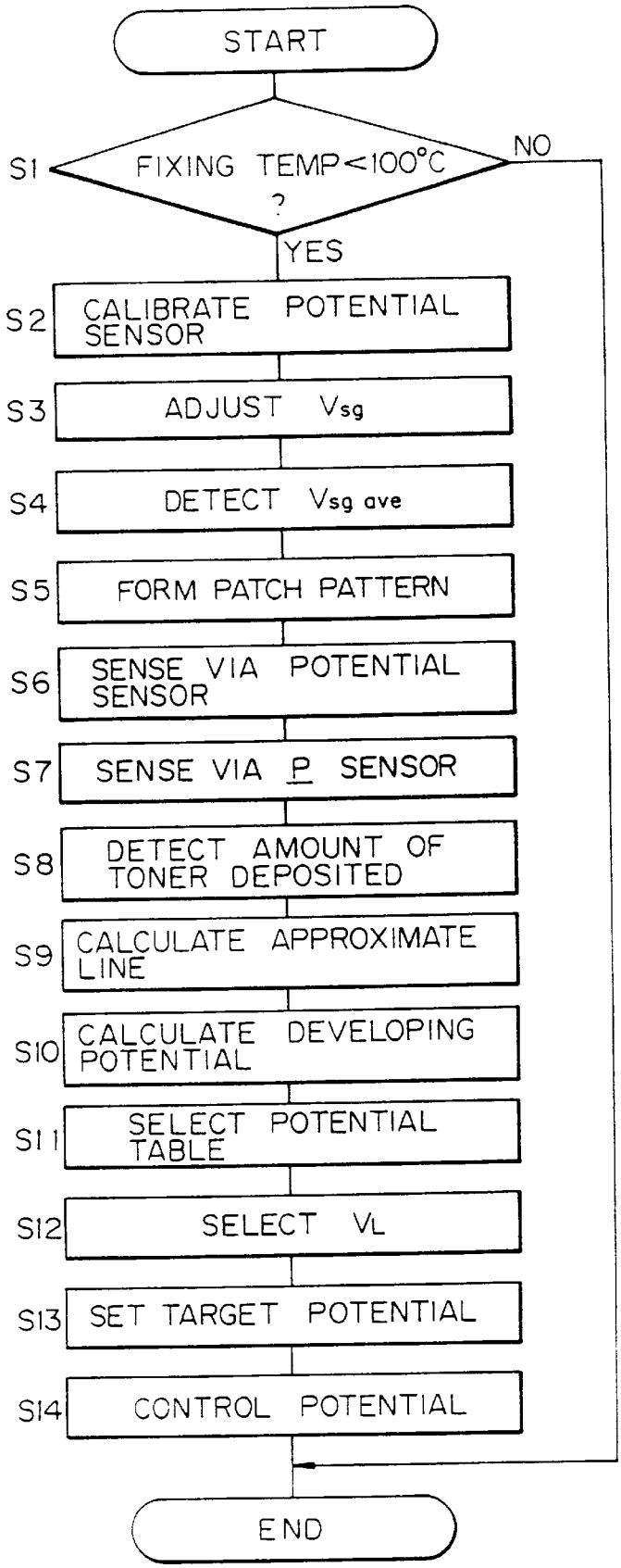
FIG. 7 is a flowchart representative of a specific routine to be executed at the time of process control self-checking.

A reference will be made to FIG. 7 for describing a routine to be executed at the time of process control self-checking. As shown, if the temperature at the fixing unit is higher than 100° C. (N, step S1), the controller 48 does not execute potential control, determining that an error has occurred. If the temperature is lower than 100° C. (Y, step S1), the controller 48 executes potential sensor calibration (step S2). Specifically, the controller 48 causes a bias power source to apply a reference potential to the drum 7 in order to calibrate the potential sensor 41 (without driving the drum 7 or the revolver 10). The controller 48 uses the calibrated value for the subsequent potential calculation. Then, the controller 48 adjusts the amount of a reflection $V_{sg}$ from the background of the drum 7 (step S3); in the illustrative embodiment, the background is the area of the drum 7 not exposed by the laser beam because the embodiment uses negative-to-positive development. Thereafter, the controller 48 once continues the illumination in order to produce an average value ($V_{sg\ ave}$). At this time, it is necessary to absorb irregularities in the reflection in the circumferential direction of the drum 7. For this purpose, the controller 48 adjusts the amount of emission from an LED (Light Emitting Device) included in the optical sensor 42 such that the output of a light-sensitive element also included in the sensor 42 and representative of the amount of incident light is 4±0.1 V in the case of Bk.

Subsequently, the controller 48 forms a patch pattern (step S5). Specifically, the controller 48 varies the laser output stepwise in order to form N (=12 in the embodiment) latent images each having a particular tone or density. The controller 48 detects the potentials of the N patches via the potential sensor 41 and stores them in the RAM (step S6).

Figure 12:
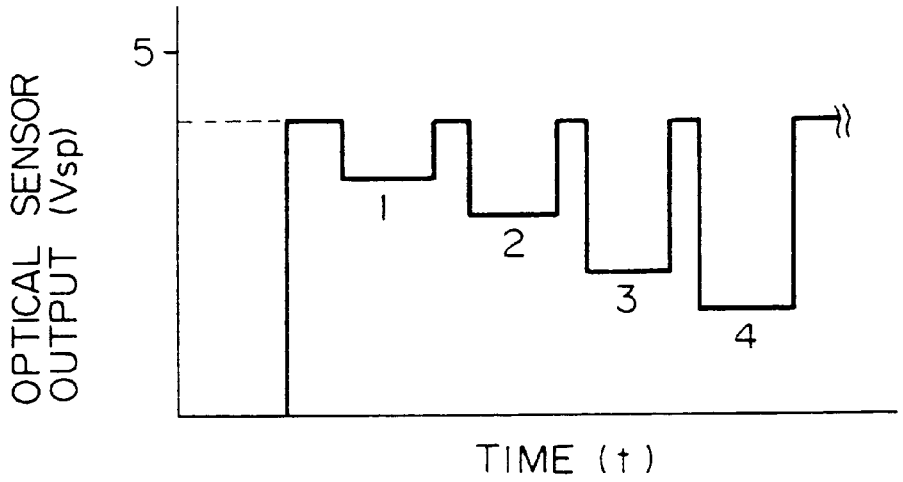
FIG. 12 is a graph showing sensor outputs derived from reference toner images respectively corresponding to patches included in the pattern of FIG. 11.

After the step S6, the controller 48 performs sensing using the optical sensor, or P sensor as sometimes referred to hereinafter, 42 (step S7). Specifically, the controller 48 causes the revolver 10 to develop the above patch pattern and produce corresponding reference toner images. The controller 48 detects the amounts of reflections from the reference toner images via the optical sensor 42, and writes them in the RAM 47 as sensor output values $V_{spi}$ (i=1 through N) respectively corresponding to the reference toner images (see FIG. 12). It is to be noted that to form such a density pattern, the bias for development may be varied with the laser output held constant. The above procedure is repeated with each of Bk, C, M and Y in this order. The controller 48 calculates the amounts of toner deposition on the basis of the sensor output values $V_{spi}$ (step S8), as follows.

Figure 13:
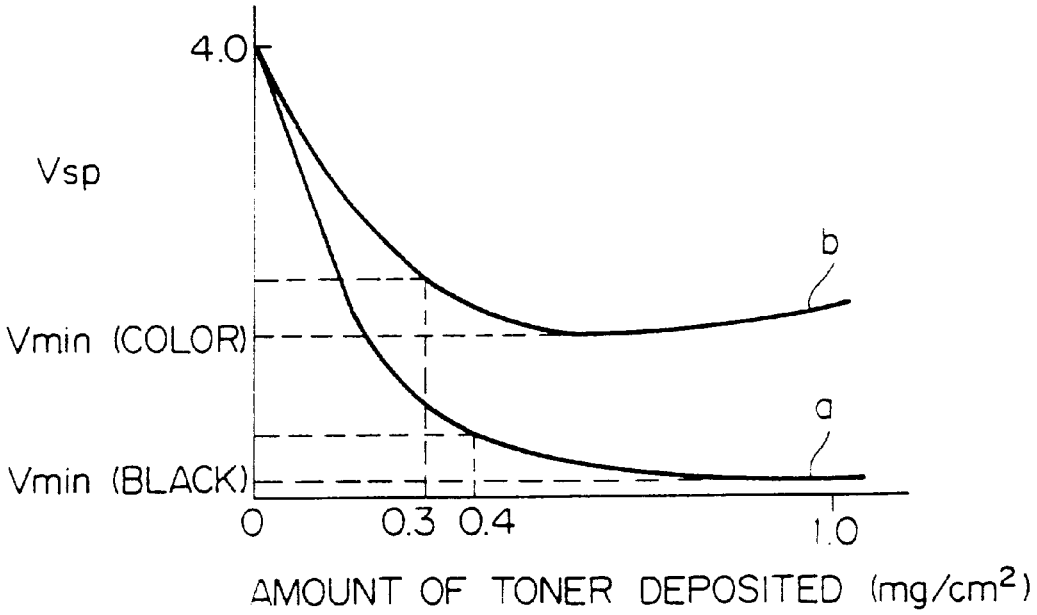
FIG. 13 is a graph showing a relation between the amount of toner deposition sensed by a reflection type sensor and the amount of reflection depending on the kind of toner.

FIG. 13 shows a relation between the amount of toner deposited on the individual reference toner image and the output of the P sensor 42. In FIG. 13, curves a and b respectively show a characteristic particular to black toner and a characteristic particular to color toner. With these curves a and b, it is possible to determine the amount of toner deposited on the drum 7 in terms of the output of the P sensor 42 in accordance with the result of adjustment of the amount of reflection from the background. As FIG. 13 indicates, the dynamic range of the curve b is narrower than the dynamic range of the curve a with respect to the amount of reflection $V_{sg}$ (=4.0) from the background. This is because a direct reflection from color toner is greater in amount that a reflection from the background of the drum 7. Because a value $V_{sp}$ at which the characteristic saturates ($V_{min}$ hereinafter) varies due to the irregularities of the optical sensor 42, drum 7, developing conditions, and so forth. Therefore, for color toner, $k=(V_{sp}-V_{min})/(V_{sg}-V_{min})$ is used for standardization (k=0.01 to 1.00). In FIG. 13, the sensor sensitivity (slope) increases as the amount of deposition decreases away from the target value. However, the range in which the amount of toner deposition is small is undesirable as a target value for toner replenishment control because development itself is unstable in such a range. As shown in FIG. 13, Bk is also standardized by use of $V_{min}$.

As stated above, the controller 48 transforms the output values of the sensor 42 produced in the step 7 to amounts of toner deposition for a unit area with reference to a table stored in the ROM 46 and listing the relation between the standardized sensor output (k) and the amount of toner deposition (step S8). The amounts of toner deposition determined in the step S8 are written to the RAM 47.

Figure 14:
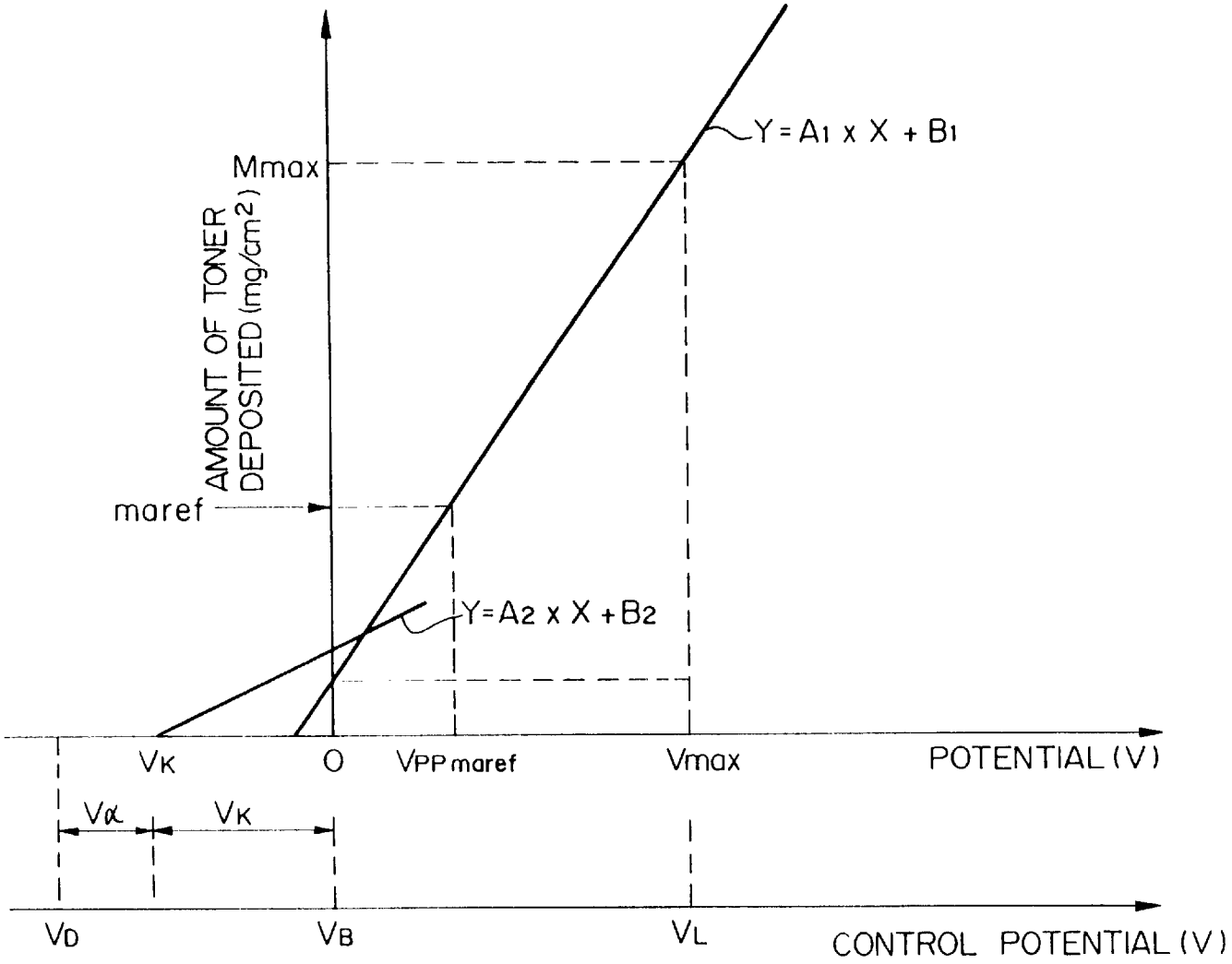
FIG. 14 shows a relation between the potential, control potential and so forth and the amount of toner deposition.

FIG. 14 plots the potential data and toner deposition data of the individual patch and produced in the steps S6 and S8, respectively, in an X-Y plane. In FIG. 14, the X axis and Y axis are respectively representative of the potential (V) (difference between the bias for development and the surface potential of the drum 7; $V_B-V_D$) and the amount of toner deposition for a unit area M/A (mg/cm$^2$).

A linear section is selected out of the pattern data derived from the potential sensor and optical sensor. The data lying in the linear section are subjected to linear approximation using the minimum square method. With the resulting linear equation (A), a control potential is calculated color by color.

Among the potential data and toner deposition data derived from the sensor outputs ($X_n$, $Y_n$; n=1 through 10), five low numbered data (n 1 through 5) are picked up and subjected to linear approximation using the minimum square method, and at the same time a correlation coefficient is calculated. This is repeated with each of data numbered n=1 through 5, data numbered n=2 through 6, data numbered 3 through 7, data numbered n =4 through 8, data numbered n=5 through 9, and data numbered n=6 through 10. As a result, six linear approximation equations (development γ) and six correlation coefficients are produced, as follows:

$Y=A_{11}\times X+B_{11}$; $R_{11}$ $Y=A_{12}\times X+B_{12}$; $R_{12}$ $Y=A_{13}\times X+B_{13}$; $R_{13}$
$Y=A_{14}\times X+B_{14}$; $R_{14}$
$Y=A_{15}\times X+B_{15}$; $R_{15}$
$Y=A_{16}\times X+B_{16}$; $R_{16}$ One of the above equations having the greatest correlation function is selected as the linear equation (A). Here, the linear equation (A) is represented by $Y=A_1\times X+B_1$ (see FIG. 14).

As for the calculation of a potential, in the above linear equation, the X value $V_{max}$ to hold when Y takes a maximum necessary deposition amount $M_{max}$ is calculated. The X value $V_{max}$, in turn, gives a bias $V_B$ for development and a potential $V_L$ for exposure, as follows:

$V_{max}=(M_{max}-B_1)/A_1$ $V_B-V_L=V_{max}=(M_{max}-B_1)/A_1$

Thus, the relation between $V_B$ and $V_L$ can be expressed by use of the coefficient of the linear equation (A).

Regarding a relation between the charge potential $V_D$ and the bias $V_B$ for development before exposure, a linear equation (B) expressed as $Y=A_2\times X+B_2$ intersects the X axis at an X coordinate $V_K$ (development start voltage). The above relation is represented by $V_D-V_B=V_K+V\alpha$ where $V\alpha$ is a voltage margin as to background contamination and determined by experiments. FIG. 15 shows a table listing a relation between $V_D$, $V_B$ and $V_L$ by using $V_{max}$ as a reference value. The closest one of the reference values $V_{max}$ is used as a reference, and the individual voltage is controlled in accordance with the table.

Subsequently, the drum 7 is radiated by the maximum laser power in order to detect a residual potential. When a residual potential is detected, the potentials read out of the table of FIG. 15 are corrected by the residual potential and then used as target potentials. The individual target potential is expressed as $V_{L0}=V_R—V_{R\ ref}$ ($V_R>V_{R\ ref}$) where $V_R$ and $V_{R\ ref}$ respectively denote the actually measured residual potential and the reference value of the residual potential. This calculation is represented by a step S13 in FIG. 7. Thereafter, the potential to be applied to the charger 8 is so adjusted as to achieve the target potential of $V_D$ (step S14). After the target value of $V_D$ has been achieved, the laser power is so adjusted as to achieve the target potential of $V_L$.

Figure 8:
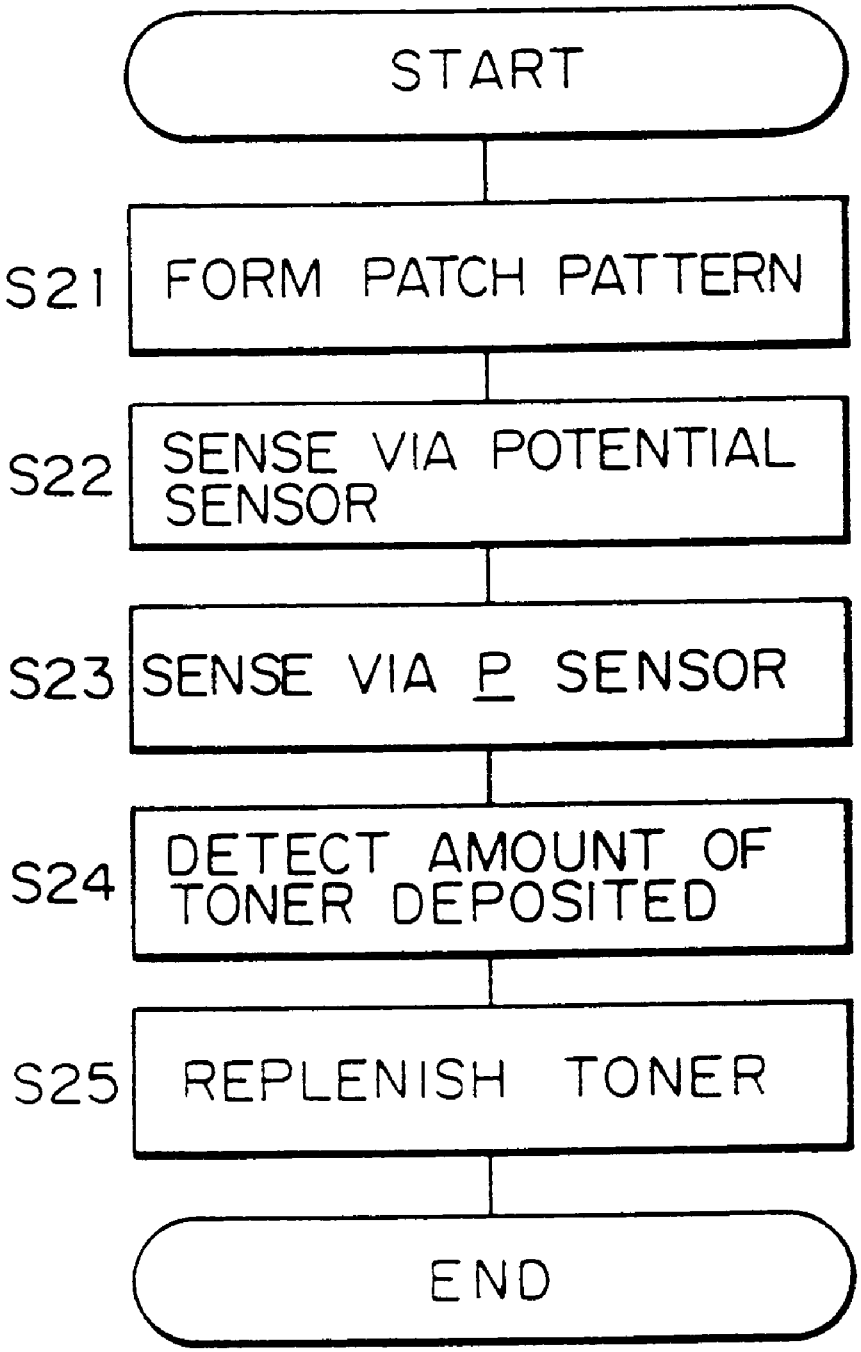
FIG. 8 is a flowchart representative of a specific routine to be executed at the time of toner replenishment control.

FIG. 8 shows a routine to be executed at the time of toner replenishment control. As shown, a halftone latent image is electrostatically formed on the drum 7 as a patch pattern (step S21). The controller 48 reads the potential of the latent image via the potential sensor 41 and writes it in the RAM 47 (step S22). Subsequently, the controller 48 causes the revolver 10 to develop the latent image on the drum 7 and thereby form a corresponding reference toner image. At this instant, the controller 48 causes a bias which is the sum of the potential stored in the RAM 47 and a preselected potential for development $V_{pp}$ to the revolver 10. In the illustrative embodiment, the above preselected potential is 80 V to 200 V for black or 80 V to 200 V for color and corrected by −10 V in a high temperature, high humidity environment or by +10 V in a low temperature, low humidity environment. The controller 48 detects the amount of a reflection from the reference toner image via the optical sensor 42 (step S23) and calculates the amount of toner deposition as at the time of process control self-checking (step S24), i.e., $k=(V_{sp}-V_{min})/(V_{sg}-V_{min})$.

Subsequently, the controller 48 controls the toner replenish motor by referencing a table, not shown, listing a relation between the amount of toner deposition and the amount of toner to be replenished. As a result, the toner is replenished. The target amount of toner deposition is 0.4 mg/cm$^2$ for black or 0.3 mg/cm$^2$ for color. In the step S24, if the amount of toner deposition is determined to be short of the target amount by 0.05 mg/cm$_2$, i.e., if it is 0.35 mg/cm$^2$ for black or 0.25 mg/cm$^2$ for color five consecutive times, the controller 46 displays a toner near end condition. Then, when ten more copies are produced, the controller 48 inhibits images from being produced in the color concerned, determining that the toner has ended. Generally, even when toner exists in a toner cartridge, it is likely that a toner end condition is erroneously detected if the developing ability is low, i.e., if the amount of toner to deposit on a photoconductive element decreases. The illustrative embodiment obviates such erroneous detection by aging.

Figure 9:
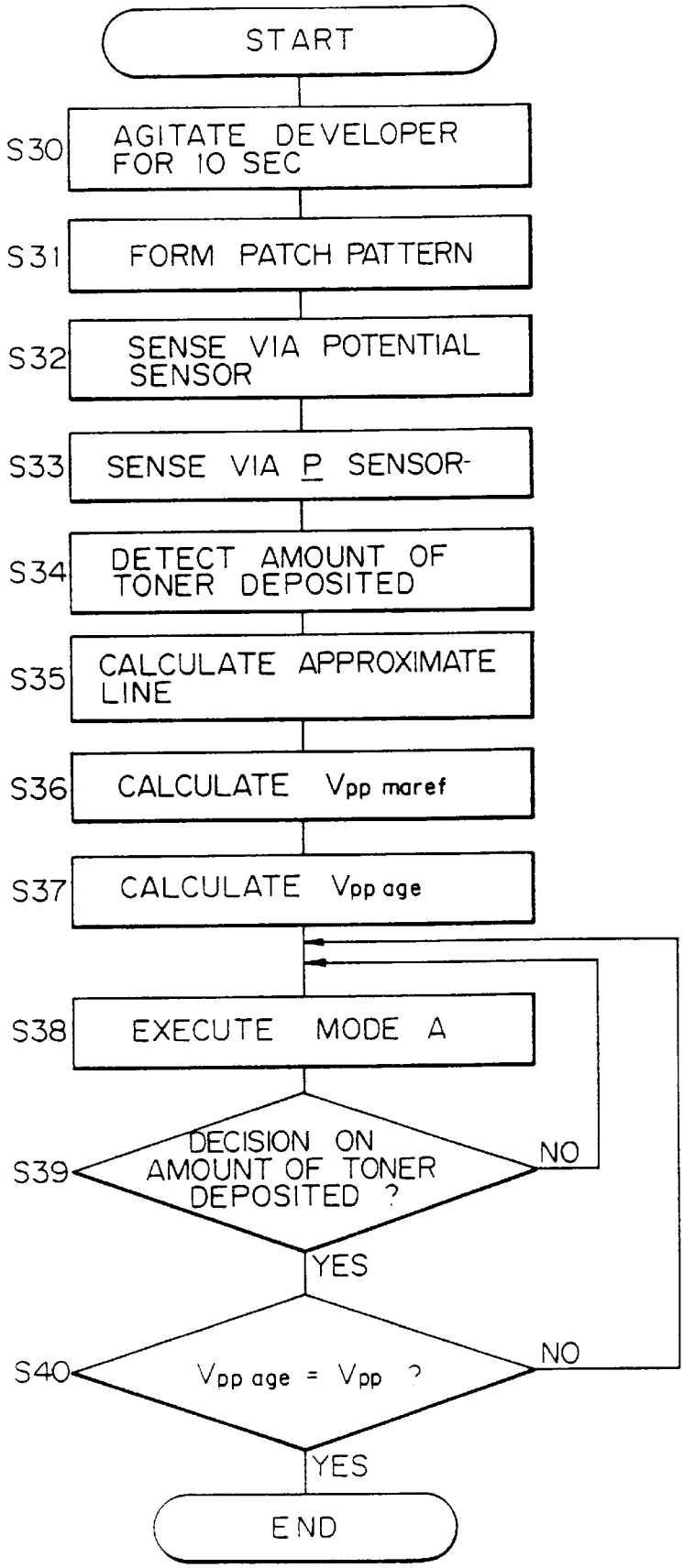
FIG. 9 is a flowchart representative of a specific routine to be executed at the time of developer aging under fixed toner replenishing conditions.

FIG. 9 shows a routine to be executed by the controller 48 at the time of the aging of the developer. At the time of installation of the copier at the user's station or at the time of periodic maintenance, preselected keys on the operation panel of the copier are operated to start the aging of the developer. After the developer has been agitated for 10 seconds (step S30), the controller 48 causes the twelve patch pattern to be formed on the drum 7 by the same latent image potential and the same bias for development as during the process control self-checking (step S31). The controller 48 determines the amounts of toner deposited on the patches of the pattern, and then calculates an approximate line. This part of the routine is the same as in the routine assigned to the process control self-checking (steps S32–S35).

Subsequently, the controller 48 calculates, based on the above approximate line, a developing potential $V_{pp\ maref}$ providing a target amount of toner deposition ma ref under preselected image forming conditions (step S36; see FIG. 14). The target amount of toner deposition is 0.4 mg/cm$_2$ for black or 0.3 mg/cm$^2$ for color.

Next, the controller 48 determines, based on the following conditions, a potential $V_{pp\ age}$ for developing the latent image pattern for toner replenishment control assigned to aging (step S37). A low temperature, low humidity environment and a normal temperature, normal humidity environment are distinguished from each other on the basis of, e.g., an absolute humidity conversion table shown in FIG. 16. Here, the point is to determine the potential $V_{pp}$ in the direction in which $V_{pp\ maref}$ approaches $V_{pp}$. Stated another way, in the illustrative embodiment, the potential for developing the latent image pattern is set stepwise in matching relation to the developer, as needed. Then, the consumption and replenishment of toner are repeated in order to attain a desired developing ability (in the embodiment, a target amount of toner deposition at a target potential for development). Assume that in a situation of the kind setting up $V_{pp\ maref}$ of 200 V, a potential of 140 V is selected at the beginning, i.e., toner replenishment ends in a single stage. Then, the sensed image density will be far lower than the actual density and will cause to the toner to be repeatedly replenished. This is apt to cause the toner to fly about and contaminate the background and thereby smear the inside of the copier.

In a low temperature, low humidity environment ($V_{pp}$= 140 V where $V_{pp}$ is a potential for developing the latent image pattern during usual image formation):

$V_{pp\ maref}>180\rightarrow V_{pp\ age}=160$ $V_{pp\ maref}\leqq 180\rightarrow V_{pp\ age}=140$ In a high temperature, high humidity environment ($V_{pp}$= 120 V):

$V_{pp\ maref}\geqq 100\rightarrow V_{pp\ age}=120$ $V_{pp\ maref}<100\rightarrow V_{pp\ age}=110$ Subsequently, an internal pattern stored in the copier is formed ten consecutive times. Then, the developing section is driven for five seconds while the revolver 10 is caused to make one revolution (360°), thereby mixing and agitating the developer and replenished toner. Let this operation be referred to as a mode A (step S38). It should be noted that the internal pattern is not transferred to papers, but the toner is consumed and replenished within the copier. In the illustrative embodiment, the internal pattern is a one-dot line pattern of size A4 positioned horizontally long; an image area occupies about 50% of the pattern. Toner replenishment is effected by use of a toner pattern formed at the rear edge of a single image forming area in the same manner as during usual image formation. Further, during the aging of the developers whether or not the step S38 should be executed is determined on the basis of the mean value of the amounts of toner deposition on the ten toner patterns. In this embodiment, if $M_a<M_{a\ ref}-0.3$, the internal pattern is formed ten more times (step S39). If the result is not acceptable, the above loop is repeated up to five times. On repeating the formation of ten images six consecutive times, the controller 48 determines whether or not $V_{pp\ age}$ is equal to $V_{pp}$ (step S40). If the answer of the step S40 is negative (N), the controller 48 sets $V_{pp\ age}=V_{pp}$, again forms the internal pattern ten times, and then executes the necessary procedure based on the mean value of the amounts of toner deposition, as stated above. If $V_{pp\ age}$ is equal to $V_{pp}$ (Y, step S40), the controller 48 ends the aging of the developer.

It is to be noted that the setting conditions of the step S37, the kind of the internal pattern, the criterion assigned to the amounts of toner deposition, the number of times of repetition of the loop and so forth shown and described are only illustrative and may be suitably varied in accordance with the system. Also, in the illustrative embodiment, the detection of a toner end condition is not performed during the aging of the developer; whether or not toner is present in the cartridge is checked before the aging.

Figures 10, 10A:
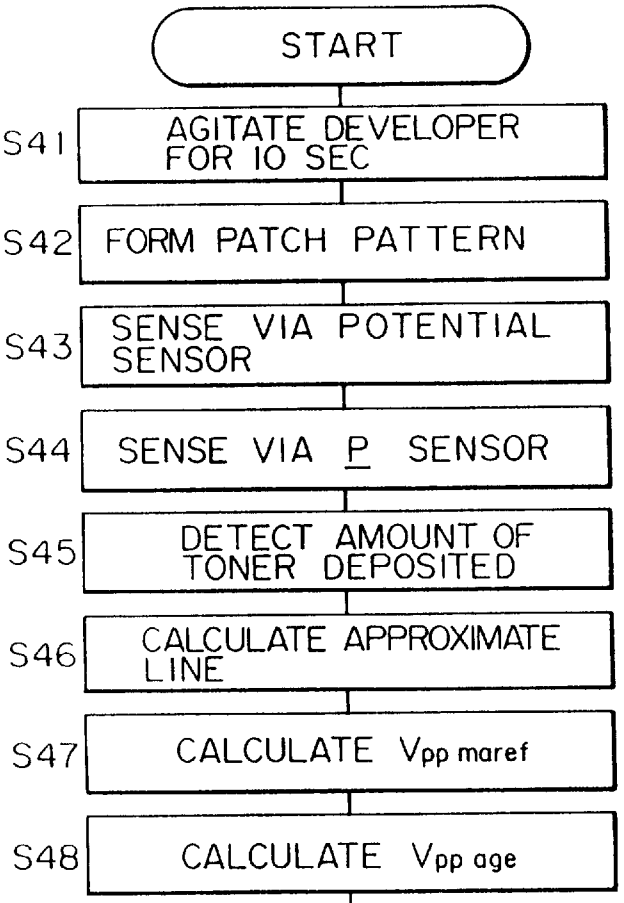
FIG. 10 is a flowchart showing another specific routine to be executed at the time of developer aging.
Figure 10B:
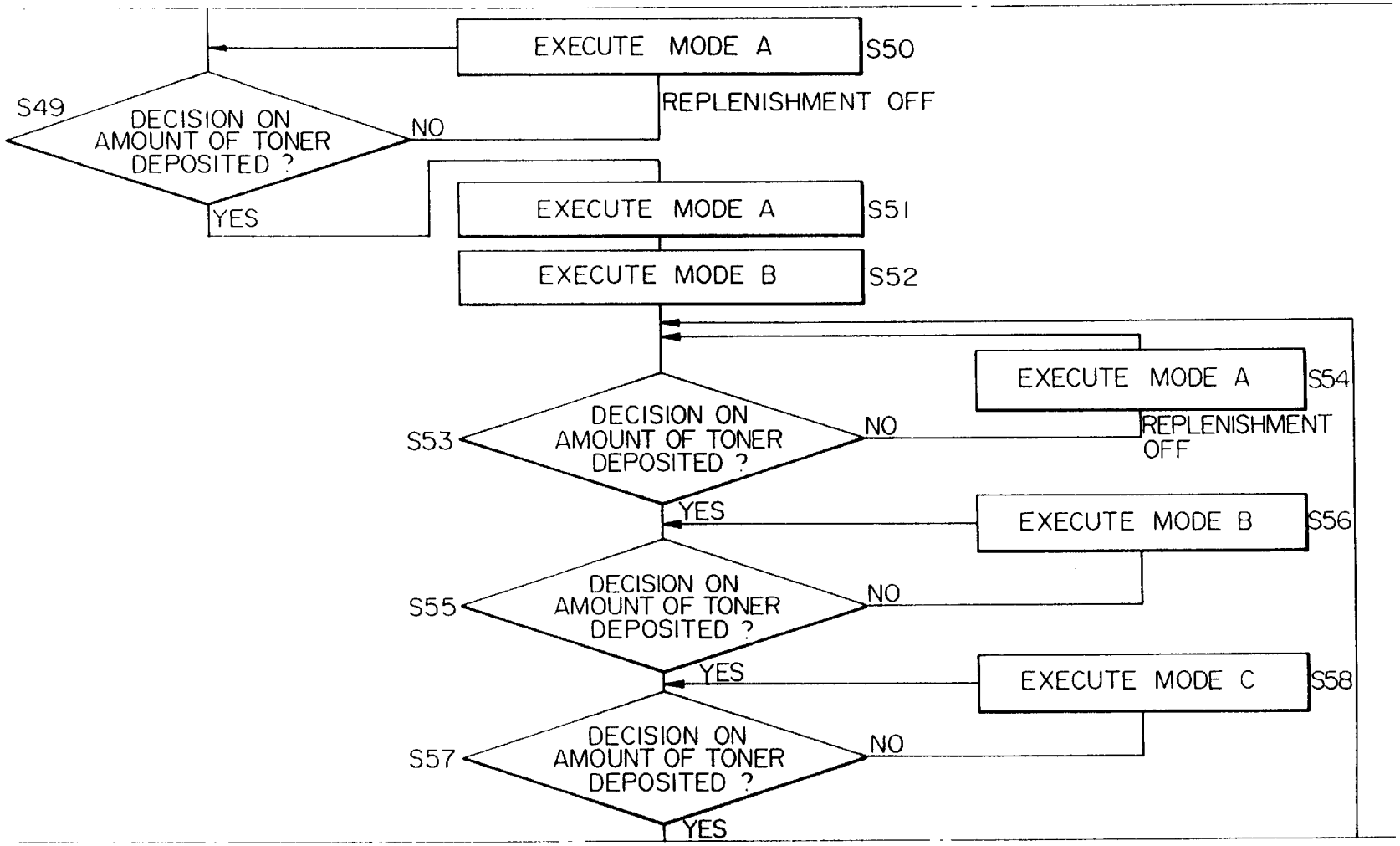
Figure 10C:
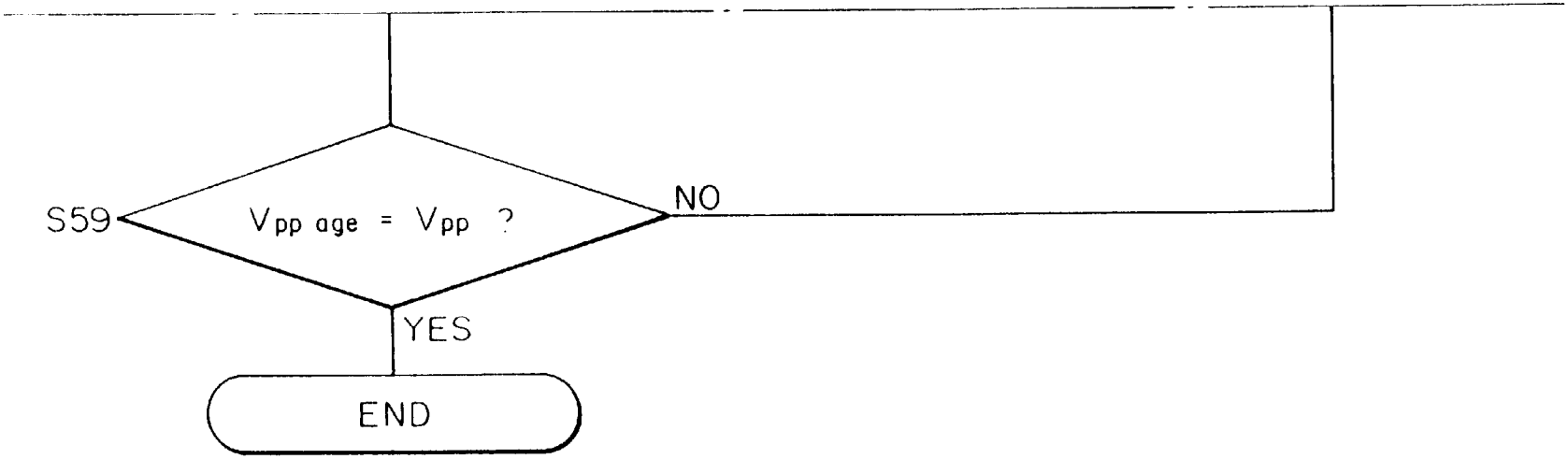
Figure 11:
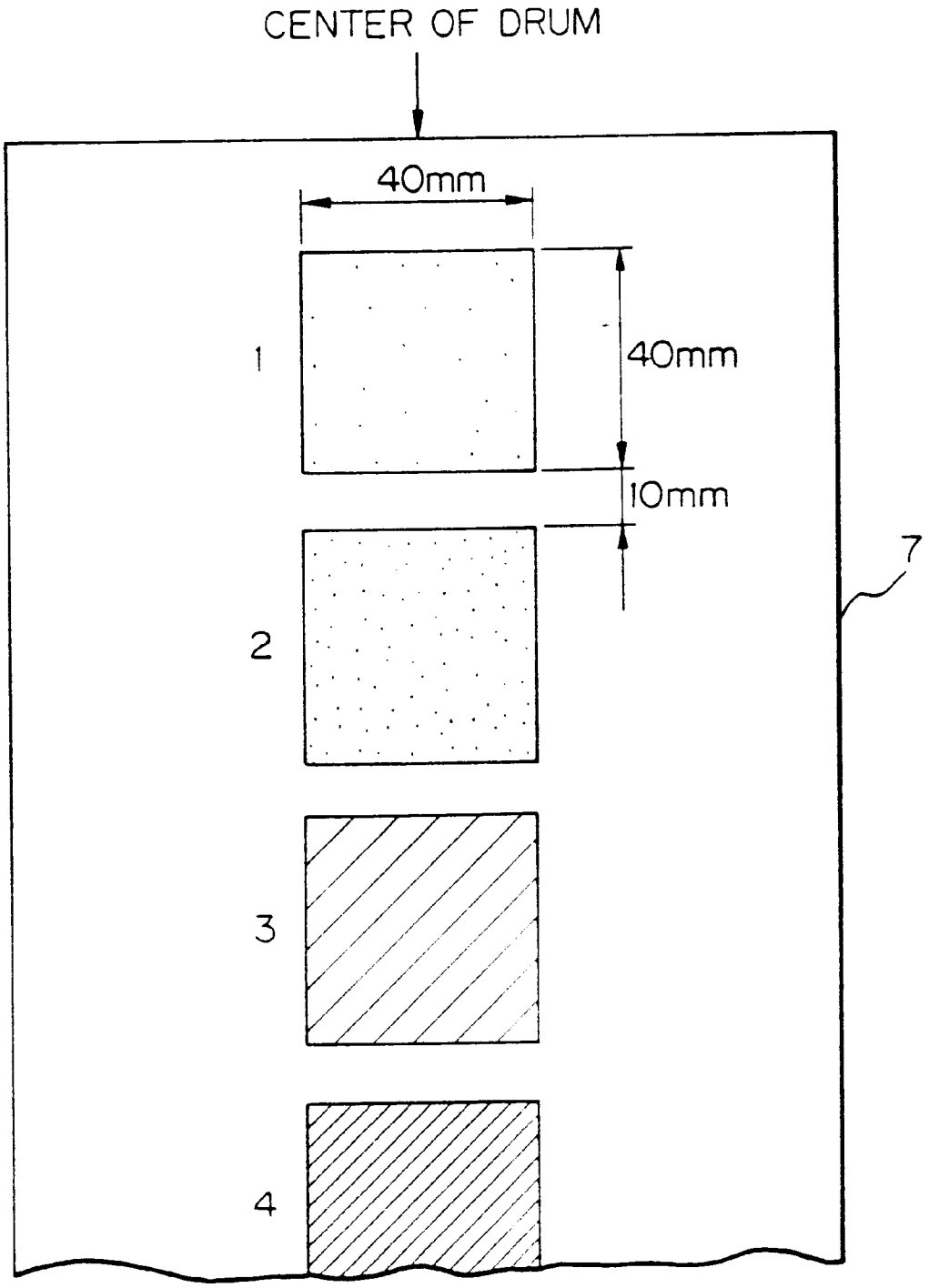
FIG. 11 shows a part of a specific twelve-tone pattern.

FIG. 10 shows a specific aging routine representative of an alternative embodiment of the present invention. As shown, steps S41–48 are respectively identical with the steps S30–S37 shown in FIG. 9. After the step S48, the amount of toner existing on the toner image produced by the calculated $V_{pp\ age}$ is measured. In this embodiment, one of the following three different toner consumption modes A, B and C is selected, depending on the developing characteristic of the developer:

Mode A: ten times of formation of a one-dot line pattern (about 50% in terms of an image area; about 0.25 g in a stable condition) of size A4 positioned horizontally long→one revolution of the revolver 10 (360°)→5 seconds of agitation Mode B: ten times of formation of a one-dot independent pattern (about 25% in terms of an image area; about 0.13 g in a stable condition) of size A4 positioned horizontally long→one revolution of the revolver 10 (360°)→5 seconds of agitation Mode C: ten times of formation of a lattice pattern (about 5% in terms of an image area; about 0.03 g in a stable condition) of size A4 positioned horizontally long→one revolution of the revolver 10 (360°)→5 seconds of agitation If the amount of toner deposition $M_a$ measured is greater than $M_{a\ ref}-0.03$ (N, step S49), the controller 48 repeats the mode A (step S50). At this time, no toner is replenished; however, if the answer of the step S49 is N eight consecutive times, the controller 48 displays an error and ends the routine. With this procedure, it is possible to cause toner to be replenished without fail without regard to the developing characteristic. Assume that the amount of toner deposition is great. Then, the amount does not decrease when the toner is consumed in a small amount, causing toner to be replenished little. As a result, a defective image occurs when toner is replenished later.

If the answer of the step S49 is positive (Y), the controller 48 executes the mode A once (step S51) and then the mode B once (step S52). This is effected with any kind of developer in order to obviated an occurrence that, e.g., a partly lost image or similar defective image is produced despite that the developer has a target ability.

The controller 48 measures the amount of toner existing on the toner pattern produced by $V_{pp\ age}$ (step S53). Then, the controller 48 repeats the mode A until the amount of toner $M_a$ becomes smaller than or equal to $M_{a\ ref}$ (step S54). At this instant, no toner is replenished; however, if the answer of the step S53 is N eight consecutive times, the controller 48 displays an error and ends the routine.

Subsequently, the controller 48 measures the amount of toner existing on the toner pattern produced by $V_{pp\ age}$ (step S55), and repeats the mode B until $M_a$ exceeds $M_{a\ ref}-0.02$ (step S56). If the answer of the step S55 is Y, the controller 48 measures the amount of toner existing on the toner pattern produced by $V_{pp\ age}$ and repeats replenishment until the amount of toner $M_a$ exceeds $M_{a\ end}$ (toner end threshold $M_{a\ ref}-0.05$; 0.4–0.05=0.35 for black or 0.3–0.05=0.25 for color). At this instant, the controller 48 references a table listing preselected amounts of toner deposition and corresponding durations of toner replenishment. If the amount $M_a$ does not exceed $M_{a\ end}$, the controller 48 displays an error (toner end) and ends the routine.

After the step S55, the controller 48 measures the amount of toner existing on the background of the drum 7 (contamination) while driving the developing section, but without driving the LD (step S57). Then, the controller 48 repeats the mode C until the amount of toner $M_a$ on the background becomes smaller than or equal to 0.10 (step S58).

If the answer of the step S58 is N eight consecutive times, the controller 48 displays and error and ends the routine.

If the answer of the step S57 is Y, the controller 48 determines whether or not $V_{pp\ age}$ is equal to $V_{pp}$ (step S59). If the answer of the step S59 is N, the controller 48 sets $V_{pp\ age}$ equal to $V_{pp}$ and then returns to the step S53. If the answer of the step S59 is Y, the controller 48 ends the aging.

The aging routines described above each is effected in the usual condition wherein a state amount relating to the desired developing characteristic is fixed. For the target developing characteristic, use is made of the amount of toner deposited on a halftone pattern which is applied to the toner replenishment control also.

Figure 17A:
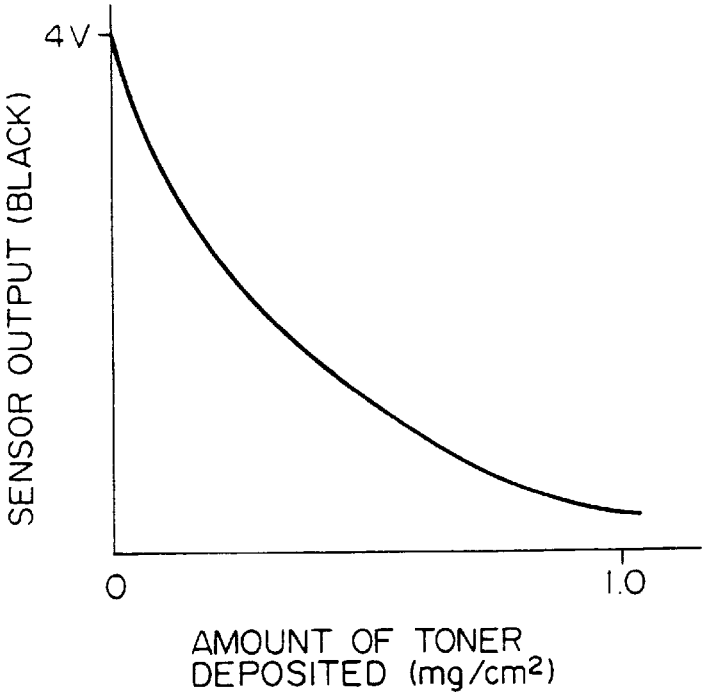
FIGS. 17A and 17B correspond to FIG. 13, and each shows a relation between the amount of toner sensed by a diffused reflection type sensor and the amount of reflection depending on the kind of toner.
Figure 17B:
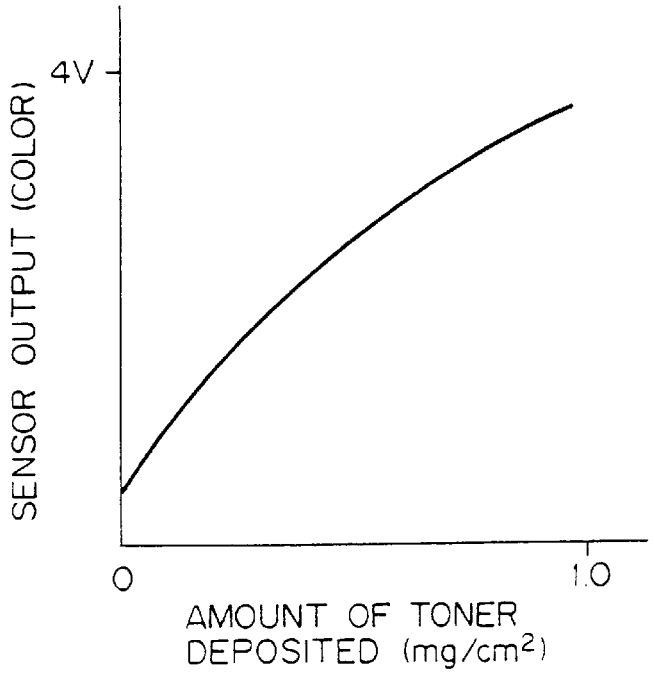

Another specific aging routine will be described hereinafter which pertains to a case wherein the state amount relating to the desired developing characteristic is variable. Assume that, among various state amounts, the toner replenishing condition ($V_{pp}$) at the time of toner replenishment is variable by being set after the aging of the developer. As for the process control self-checking, the routine described with reference to FIG. 7 also applies to this case. When the P sensor of reflection sensing type used in the previous embodiment is replaced with a P sensor of diffused reflection sensing type, the sensor output varies in accordance with the amount of toner deposited on a reference toner image, as shown in FIG. 17A or 17B. Curves shown in FIGS. 17A and 17B pertain to black toner and color toner, respectively. As shown, this type of P sensor also has sensitivity up to about 1.0 mg/cm$_2$ occurring with a solid toner image (maximum density) during usual image formation. The amount of toner deposition on the drum 7 is determined in terms of the output of the P sensor on the basis of the adjustment of the reflection from the background of the drum 7 to the P sensor, as stated earlier. The controller 48 converts the output of the P sensor determined in the step 7 to an amount of toner deposition for a unit area and writes the amount of toner deposition in the RAM 47 (step 8). This is followed the procedure described above.

Figures 18, 18A:
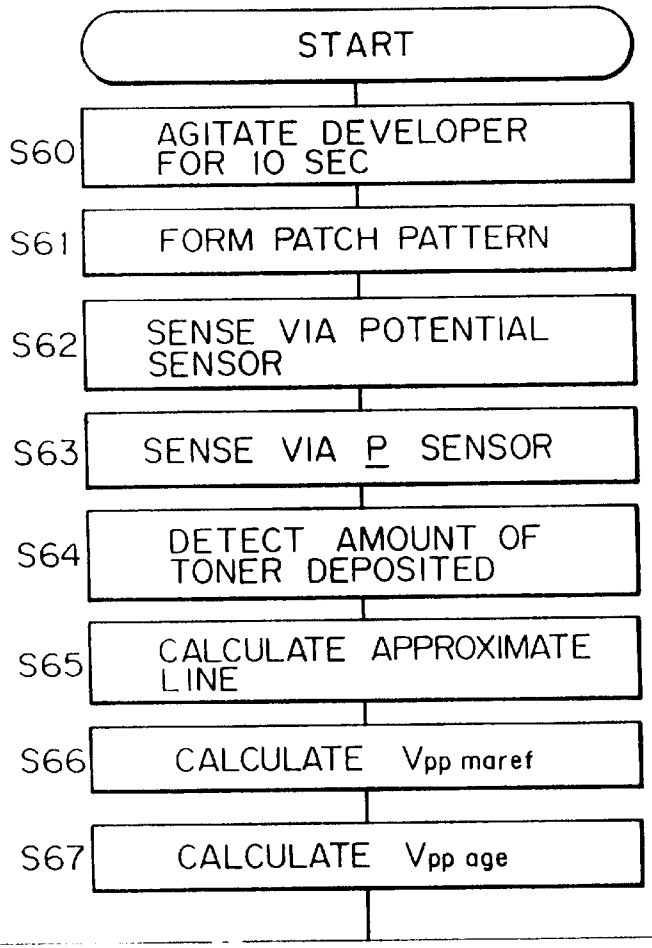
FIG. 18 is a flowchart demonstrating a specific routine to be executed at the time of aging, but under variable toner replenishing conditions.
Figure 18B:
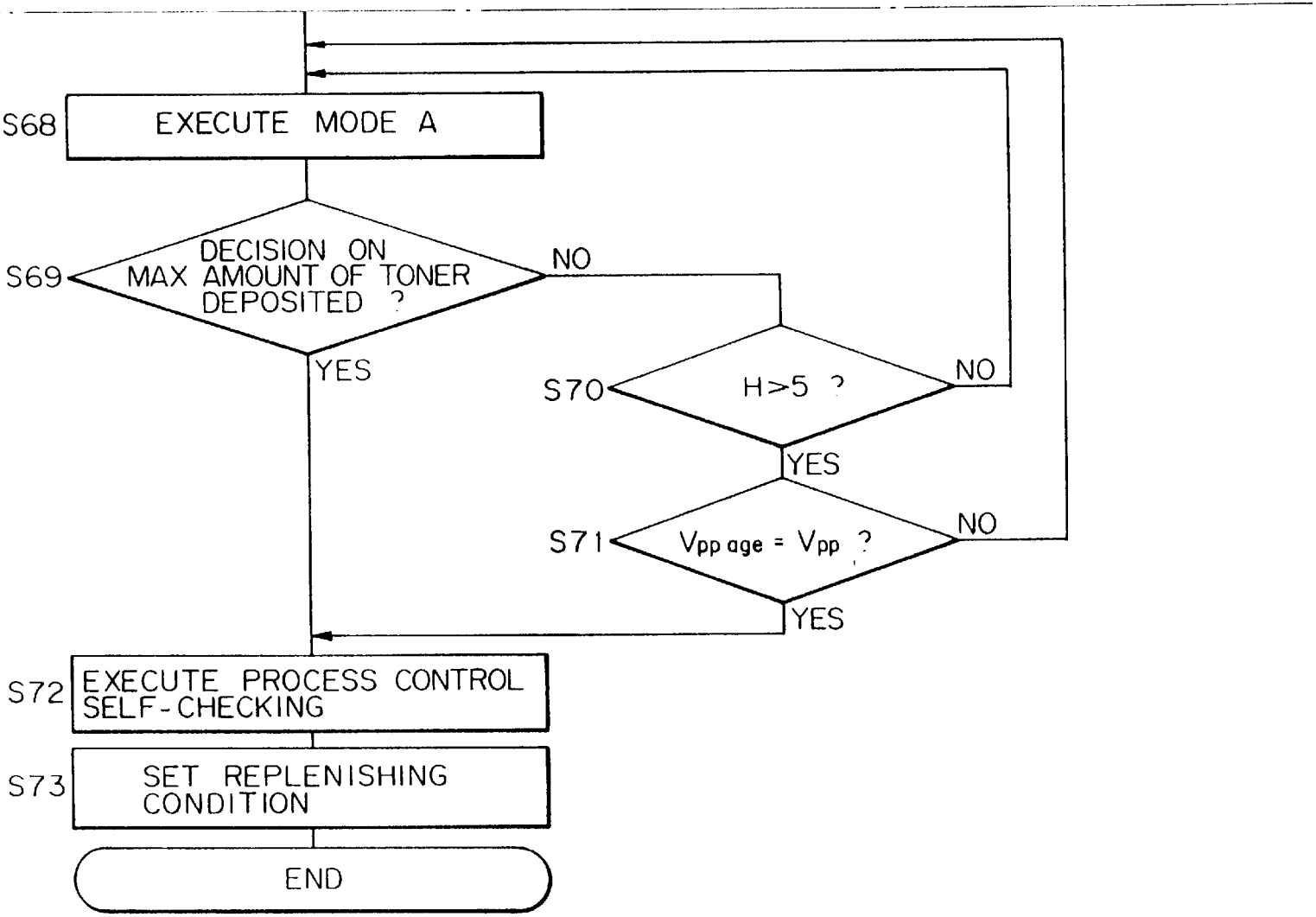

Reference will be made to FIGS. 18 for describing an aging routine particular to this embodiment. As shown, when the operation panel is manipulated to start the aging of the developer, the controller 48 agitates the developer for 10 seconds (step S60) and forms the twelve patch pattern with the same latent image potential and the same bias as during process control self-checking (step S61). Then, the controller 48 determines the amounts of toner deposited on the patches and then calculates an approximate line. This part of the routine is the same as in the process control self-checking. (steps S5–S9).

Subsequently, the controller 48 determines, based on the following conditions, the potential $V_{pp\ age}$ for developing the latent image pattern for toner replenishment control to be executed during aging (step S67). In this specific routine, parenthesized values of $V_{pp}$ are selected for the aging.

In a low temperature, low humidity environment ($V_{pp}$= 140 V where $V_{pp}$ is a potential for developing the latent image pattern during usual image formation):

$V_{pp\ maref}>180 \rightarrow V_{pp\ age}=160$ $V_{pp\ maref}\leqq 180 \rightarrow V_{pp\ age}=140$ In a normal temperature, normal humidity environment ($V_{pp}$=130 V):

$$110 \leq V_{pp\ maref} \leq 170 \rightarrow V_{pp\ age} = 130$$

$$V_{pp\ maref} > 170 \rightarrow V_{pp\ age} = 150$$

$$V_{pp\ maref} < 100 \rightarrow V_{pp\ age} = 110$$

In a high temperature, high humidity environment ($V_{pp}$= 120 V):

$V_{pp\ maref}\geqq 100 \rightarrow V_{pp\ age}=120$ $V_{pp\ maref}<100 \rightarrow V_{pp\ age}=110$ Subsequently, the internal pattern stored in the copier is formed ten consecutive times. Then, the developing section is driven for five seconds while the revolver 10 is caused to make one revolution (360°), thereby mixing and agitating the developer and replenished toner. Let this operation be referred to as the mode A (step S68). It should be noted that the internal pattern is not transferred to papers, but the toner is consumed and replenished within the copier. In the illustrative embodiment, the internal pattern is a one-dot line pattern of size A4 positioned horizontally long; an image area occupies about 50% of the pattern. Toner replenishment is effected by use of a toner pattern formed at the rear edge of a single image forming area in the same manner as during usual image formation. Further, during the aging of the developer, the formation of the toner pattern for toner replenishment is followed by the formation of a pattern for measuring the maximum amount of toner deposition ($M_{a\ max}$). This pattern is formed by the maximum amount of light available with the LD and under the conditions used to form the internal patten ($V_D$ of −650 V and VB of −500 V). If the maximum amount of toner $M_{a\ max}$ lies in a preselected range, the controller 48 executes a step 72; if otherwise, it executes a step S69.

In the illustrative embodiment, the above preselected range is determined by use of a temperature sensor and a humidity sensor and a table shown in FIG. 19. If the answer of the step S69 is N, the controller 48 repeats this loop up to five times. After ten times of formation of the above pattern has been repeated six times in total, the controller 48 executes a step S70. Subsequently, the controller 48 determines whether or not $V_{pp\ age}$ is equal to $V_{pp}$ (step S71). If the answer of the step S71 is N, the controller 48 sets $V_{pp\ age}$ equal to $V_{pp}$ and again forms the internal pattern ten times. If the answer of the step S71 is Y, the controller 48 executes a step 72. It is to be noted that the setting conditions of the step S67, the kind of the internal pattern, the criterion assigned to the amounts of toner deposition, the number of times of repetition of the loop and so forth shown and described are only illustrative and may be suitably varied in accordance with the system.

A halftone pattern is susceptible to the accuracy of P and V sensors, the sensitivity of a photoconductive element, environment, and so forth, so that delicate calibration would increase the period of time necessary for the routine to be completed. By measuring the maximum amount of toner deposition, as in the above procedure, it is possible to complete the minimum necessary degree of aging in a short period of time. This, however, causes the developing ability to have a substantial width. In light of this, in the step S72, the process control self-checking shown in FIG. 7 is executed in order to determine an optimal developing condition The controller 48 again determines, based on the approximation equation relating to development γ and obtained in the step S72, the developing potential of the P sensor pattern ($V_{pp\ maref}$) which will provide the target value ($M_{a\ ref}$) for toner replenishment control. This potential is used as a developing potential ($V_{pp}$) of a P sensor pattern during usual image formation. As a result, there is obviated an occurrence that, e.g., when a developer whose developing ability is relatively low is used and toner replenishment is controlled by fixed $V_{pp}$, the resulting P sensor pattern has low density and causes toner replenishment to be repeated, resulting in the variation of image density. It is to be noted that when a toner end condition is detected during the routine, the controller 48 determines that an error has occurred, and must repeat the routine all over again.

Figures 20, 20A:
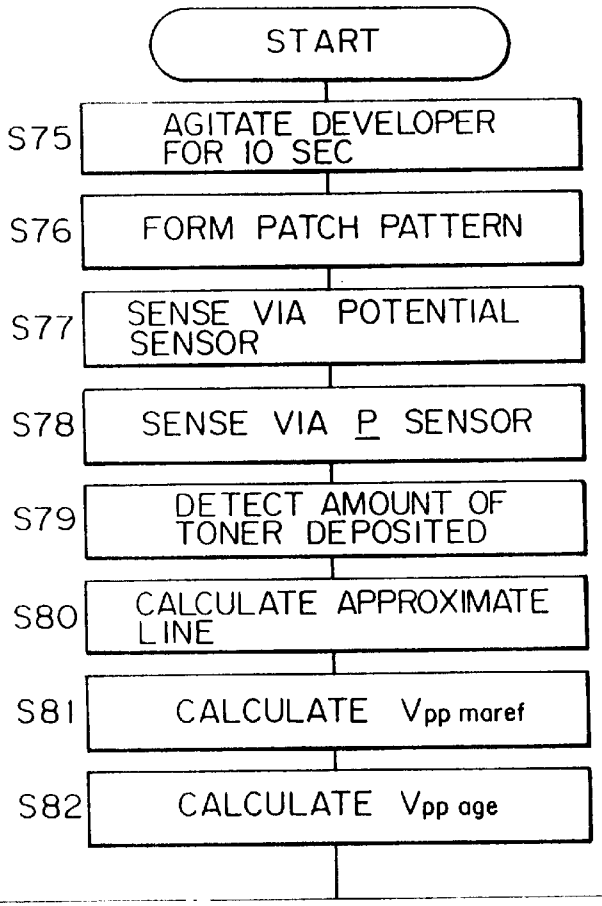
FIG. 20 is a flowchart showing a specific similar to, but different from, the routine of FIG. 18.
Figure 20B:
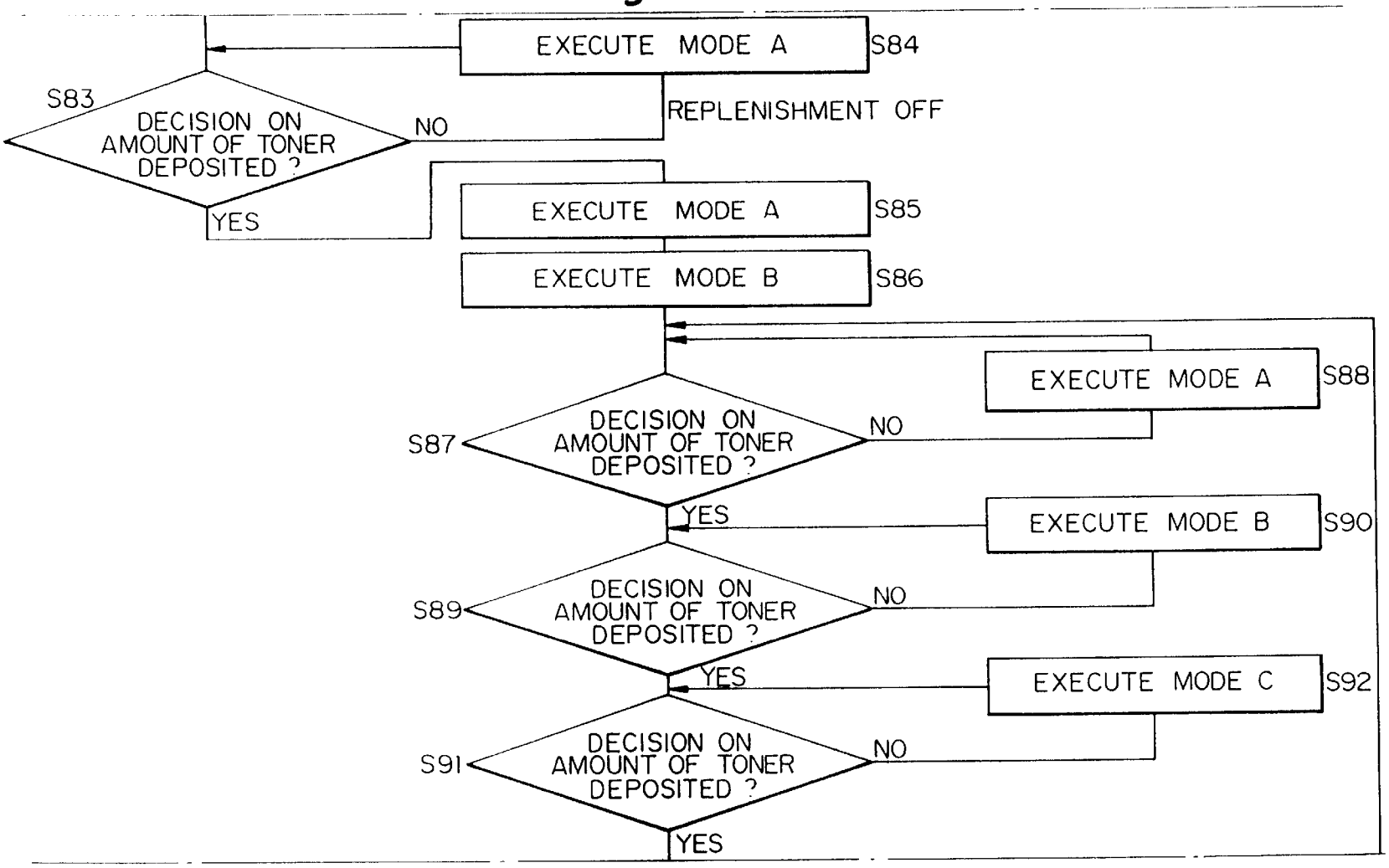
Figure 20C:
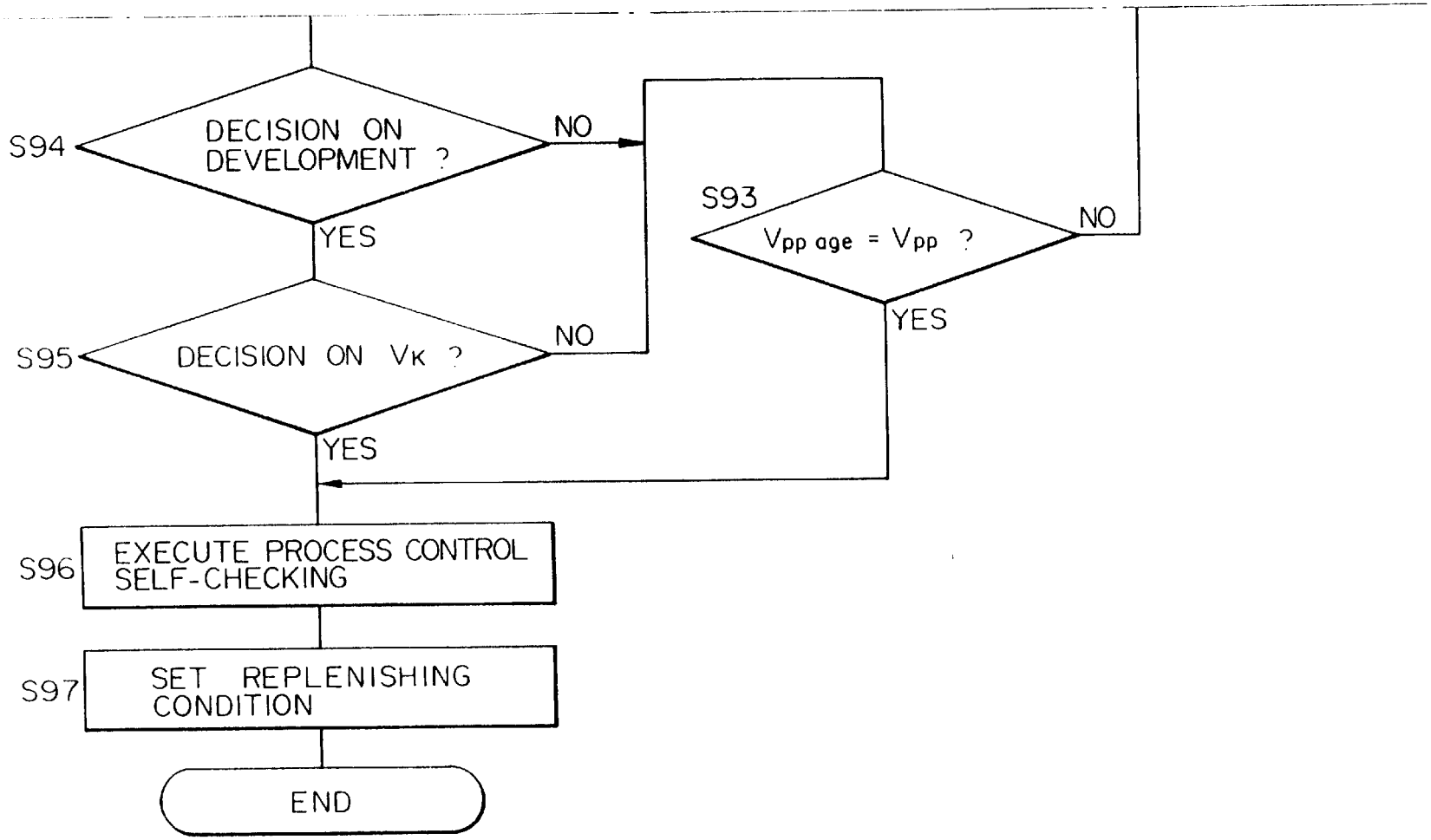

Another specific aging routine will be described with reference to FIG. 20. As shown, after steps S75–S82 are respectively identical with the steps S41–S48 shown in FIG. 10. After the step S82, the amount of toner existing on the toner image produced by the calculated $V_{pp\ age}$ is measured. In this embodiment, one of the following three different toner consumption modes A, B and C is also selected, depending on the developing characteristic of the developer:

Mode A: ten times of formation of a one-dot line pattern (about 50% in terms of an image area; about 0.25 g in a stable condition) of size A4 positioned horizontally long→one revolution of the revolver 10 (360°)→5 seconds of agitation Mode B: ten times of formation of a one-dot independent pattern (about 25% in terms of an image area; about 0.13 g in a stable condition) of size A4 positioned horizontally long→one revolution of the revolver 10 (360°)→5 seconds of agitation Mode C: ten times of formation of a lattice pattern (about 5% in terms of an image area; about 0.03 g in a stable condition) of size A4 positioned horizontally long→one revolution of the revolver 10 (360°)→5 seconds of agitation If the amount of toner deposition $M_a$ measured is greater than $M_{a\ ref}$−0.03 (N, step S83), the controller 48 repeats the mode A (step S84). At this time, no toner is replenished; however, if the answer of the step S83 is N eight consecutive times, the controller 48 displays an error and ends the routine. With this procedure, it is possible to cause toner to be replenished without fail without regard to the developing characteristic. Assume that the amount of toner deposition is great. Then, the amount does not decrease when the toner is consumed in a small amount, causing toner to be replenished little. As a result, a defective image occurs when toner is replenished later.

If the answer of the step S83 is positive Y, the controller 48 executes the mode A once (step S85) and then the mode B once (step S86). This is effected with any kind of developer in order to obviated an occurrence that, e.g., a partly lost image or similar defective image is produced despite that the developer has a target ability.

The controller 48 measures the amount of toner existing on the toner pattern produced by $V_{pp\ age}$ (step S87). Then, the controller 48 repeats the mode A until the amount of toner $M_a$ becomes smaller than or equal to $M_{a\ ref}$ (step S88). At this instant, no toner is replenished; however, if the answer of the step S87 is N eight consecutive times, the controller 48 displays an error and ends the routine.

Subsequently, the controller 48 measures the amount of toner existing on the toner pattern produced by $V_{pp\ age}$ (step S89), and repeats the mode B until $M_a$ exceeds $M_{a\ ref}-0.02$ (step S90). Then, the controller 48 measures the amount of toner existing on the toner pattern produced by $V_{pp\ age}$, and repeats replenishment until the amount of toner $M_a$ exceeds $M_{a\ end}$ (toner end threshold $M_{a\ ref}-0.05$; 0.4–0.05=0.35 for black or 0.3–0.05=0.25 for color). At this instant, the controller 48 references the table listing preselected amounts of toner deposition and corresponding durations of toner replenishment. If the amount $M_a$ does not exceed $M_{a\ end}$, the controller 48 displays an error (toner end) and ends the routine.

After the step S89, the controller 48 measures the amount of toner existing on the background of the drum 7 (contamination) while driving the developing section, but without driving the LD (step S91). Then, the controller 48 repeats the mode C until the amount of toner $M_a$ on the background becomes smaller than or equal to 0.10 (step S92). If the answer of the step S92 is N eight consecutive times, the controller 48 displays and error and ends the routine.

Subsequently, in a step S94, the controller 48 repeats the steps 76–S80 in order to determine development γ and performs the following decision:

$2.0<\text{development}\gamma<4.0$

If the above relation is satisfied, the controller 48 determines a development start voltage $V_k$ and sees if it lies in the following range (step S95):

$-60<V_k<0$

If the answer of the step S95 is Y, the controller 48 executes the process control self-checking, sets the replenishing condition, and the ends the routine. If the answer of the step S95 is N, the controller 48 determines whether or not $V_{pp\ age}$ is equal to $V_{pp}$ (step S93). If the answer of the step S93 is N, the controller 48 sets $V_{pp\ age}$ equal to $V_{pp}$ and then returns to the step S87. If the answer of the step S93 is Y, the controller 48 executes the step S96.

As stated above, the developing potential of a pattern for the measurement of the amount of toner deposition and the toner consumption pattern are suitably selected in matching relation to the developing characteristic of the developer. The aging is automatically effected until a desired developing characteristic has been set up. As a result, high quality images can be stably produced after the aging. Further, when not only the halftone but also the development γ and $V_k$ are used to determine the condition of the developer, the desired range can be attained in a shorter period of time.

In summary, in accordance with the present invention, a reference latent image pattern is formed on an image carrier, and its surface potential is measured. Then, the latent image pattern is developed, and the amount of toner deposited on the pattern is measured. A state amount relating to the instantaneous developing characteristic is calculated on the basis of the potentials and the amounts of toner depositions. The aging of a developer is effected, based on the calculated amount, such that a desired developing characteristic is set up. Therefore, even if the initial charge deposited on the developer or the environment changes, there can be produced high quality images free from local omission, carrier deposition, density variation, and so forth. In addition, the wasteful consumption of papers is eliminated.

If the state amount relating to the developing characteristic is an amount assigned to toner replenishment control to be executed during developer aging, toner can be adequately replenished in accordance with the developing characteristic, obviating carrier deposition and the flying of the toner. While any desired kind of sensor is usable so long as it can sense a developing ability, an optical sensor is capable of sensing the amount of development on the image carrier easily. Assume that the state amount relating to the developing characteristic is a potential for developing the latent image pattern assigned to toner replenishment control to occur during aging. Then, at the time of toner replenishment control using an optical sensor, there can be used an advantageous region regarding the accuracy of the sensor. This further promotes the stable sensing of the amount of toner deposition. When the amount relating to the developing characteristic is one particular to an internal pattern consuming a different amount of toner during aging, not only aging matching the developing characteristic but also a decease in aging time are achievable.

During aging, if the toner is consumed without any replenishment until a preselected amount of toner deposition has been set up, the applicable range of developing characteristic is broadened without regard to the developing characteristic or the environment. In addition, this reduces the aging time. If desired, the condition for toner replenishment control may be automatically switched once during aging such that the condition finally meets a condition assigned to usual image formation. This kind of scheme successfully prevents the image density from varying during usual image formation and obviates erroneous sensing of an optical sensor. Assume that the selection of the internal pattern is selecting a pattern consuming much toner when the developing ability is higher than a target ability, or selecting a pattern consuming little toner when the former is lower than the latter. Then, the aging time and wasteful toner consumption can be further reduced, and the erroneous sensing of the optical sensor is obviated. When the selection of the internal pattern is selecting a pattern consuming little toner when the background of the photoconductive element is noticeably contaminated, the contamination can be eliminated rapidly and automatically. Assume an image forming apparatus using a revolver type developing device and causes, at the time of aging, the revolver to make at least one revolution after the replenishment of toner. Then, efficient agitation is enhanced to promote accurate sensing. In addition, the revolution of the revolver to occur during usual image formation later will prevent image density from varying and protect the background from contamination.

Various modifications will become possible for those skilled in the art after receiving the teachings of the present disclosure without departing from the scope thereof.

What is claimed is:

1. An image forming apparatus for forming a toner image on a photoconductive element with charging means, exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means, replenishment of toner to said developing means and consumption of toner by said developing means;

control means for controlling said aging executing means such that said state amount calculated by said calculating means coincides with a desired state amount;

toner density measuring means for measuring an amount of toner existing on a toner pattern produced by developing a reference latent image pattern; and an aging mode for measuring a toner density on said image carrier, for calculating a characteristic value of said developer on a basis of the measured toner density, and for effecting aging to control said state amount to said desired state amount to thereby age said developer.

2. An apparatus as claimed in claim 1, further comprising environment sensing means for sensing an environment when said calculating means calculates said state amount.

3. An apparatus as claimed in claim 2, wherein said developing means comprises a plurality of developing sections, and said apparatus further includes means for setting a different desired state amount for each developing section of said plurality of developing sections.

4. An apparatus as claimed in claim 2, further comprising image forming condition varying means for varying an image forming condition assigned to usual image formation at a desired timing such that a desired image is produced.

5. An apparatus as claimed in claim 4, wherein said developing means comprises a plurality of developing sections, and said apparatus further includes means for setting a different desired state amount for each developing section of said plurality of developing sections.

6. An apparatus as claimed in claim 1, further comprising image forming condition varying means for varying an image forming condition assigned to usual image formation at a desired timing such that a desired image is produced.

7. An apparatus as claimed in claim 6, wherein said developing means comprises a plurality of developing sections, and said apparatus further includes means for setting a different desired state amount for each developing section of said plurality of developing sections.

8. An apparatus as claimed in claim 1, wherein said developing means comprises a plurality of developing sections, and said apparatus further includes means for setting a different desired state amount for each developing section of said plurality of developing sections.

9. An image forming apparatus for forming a toner image on a photoconductive element with charging means, exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means, replenishment of toner to said developing means and consumption of toner by said developing means;

control means for controlling said aging executing means such that said state amount calculated by said calculating means coincides with a desired state amount;

environment sensing means for sensing an environment when said calculating means calculates said state amount; and image forming condition varying means for varying an image forming condition assigned to usual image formation at a desired timing such that a desired image is produced;

wherein said image forming condition varying means calculates, after aging of the developer, an image forming condition for usual image formation, controls a potential in order to set up said image forming condition, and uses a resulting controlled potential for subsequent image formation.

10. An apparatus as claimed in claim 9, wherein said developing means comprises a plurality of developing sections, and said apparatus further includes means for setting a different desired state amount for each developing section of said plurality of developing sections.

11. An image forming apparatus for forming a toner image on a photoconductive element with charging means, exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means, replenishment of toner to said developing means and consumption of toner by said developing means; and control means for controlling said aging executing means such that said state amount calculated by said calculating means coincides with a desired state amount;

wherein said state amount relating to the developing characteristic comprises a maximum amount of toner deposition implementing image formation, said control means driving said aging executing means until said maximum amount lies in a range above an amount implementing a target image.

12. An apparatus as claimed in claim 11, wherein said developing means comprises a plurality of developing sections, and said apparatus further includes means for setting a different desired state amount for each developing section of said plurality of developing sections.

13. An apparatus as claimed in claim 11, further comprising image forming condition varying means for varying an image forming condition assigned to usual image formation at a desired timing such that a desired image is produced.

14. An apparatus as claimed in claim 13, wherein said developing means comprises a plurality of developing sections, and said apparatus further includes means for setting a different desired state amount for each developing section of said plurality of developing sections.

15. An apparatus as claimed in claim 13, wherein said image forming condition varying means calculates, after aging of the developer, an image forming condition for usual image formation, controls a potential in order to set up said image forming condition, and uses a resulting controlled potential for subsequent image formation.

16. An apparatus as claimed in claim 15, wherein said developing means comprises a plurality of developing sections, and said apparatus further includes means for setting a different desired state amount for each developing section of said plurality of developing sections.

17. An image forming apparatus for forming a toner image on a photoconductive element with charging means, exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means, replenishment of toner to said developing means and consumption of toner by said developing means; and control means for controlling said aging executing means such that said state amount calculated by said calculating means coincides with a desired state amount;

wherein said state amount relating to the developing characteristic comprises development γ derived from a plurality of reference patterns, said control means driving said aging executing means until said development γ lies in a preselected range of target development γ.

18. An apparatus as claimed in claim 17, wherein said developing means comprises a plurality of developing sections, and said apparatus further includes means for setting a different desired state amount for each developing section of said plurality of developing sections.

19. An apparatus as claimed in claim 17, further comprising image forming condition varying means for varying an image forming condition assigned to usual image formation at a desired timing such that a desired image is produced.

20. An apparatus as claimed in claim 19, wherein said developing means comprises a plurality of developing sections, and said apparatus further includes means for setting a different desired state amount for each developing section of said plurality of developing sections.

21. An apparatus as claimed in claim 19, wherein said image forming condition varying means calculates, after aging of the developer, an image forming condition for usual image formation, controls a potential in order to set up said image forming condition, and uses a resulting controlled potential for subsequent image formation.

22. An apparatus as claimed in claim 21, wherein said developing means comprises a plurality of developing sections, and said apparatus further includes means for setting a different desired state amount for each developing section of said plurality of developing sections.

23. An image forming apparatus for forming a toner image on a photoconductive element with charging means, exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means replenishment of toner to said developing means and consumption of toner by said developing means; and control means for controlling said aging executing means such that said state amount calculated by said calculating means coincides with a desired state amount;

wherein said state amount relating to the developing characteristic comprises a development start voltage derived from a plurality of reference patterns, said control means driving said aging executing means such that said development start voltage lies in a preselected range of a target development start voltage.

24. An apparatus as claimed in claim 23, wherein said developing means comprises a plurality of developing sections, and said apparatus further includes means for setting a different desired state amount for each developing section of said plurality of developing sections.

25. An apparatus as claimed in claim 23, further comprising image forming condition varying means for varying an image forming condition assigned to usual image formation at a desired timing such that a desired image is produced.

26. An apparatus as claimed in claim 25, wherein said developing means comprises a plurality of developing sections, and said apparatus further includes means for setting a different desired state amount for each developing section of said plurality of developing sections.

27. An apparatus as claimed in claim 25, wherein said image forming condition varying means calculates, after aging of the developer, an image forming condition for usual image formation, controls a potential in order to set up said image forming condition, and uses a resulting controlled potential for subsequent image formation.

28. An apparatus as claimed in claim 27, wherein said developing means comprises a plurality of developing sections, and said apparatus further includes means for setting a different desired state amount for each developing section of said plurality of developing sections.

29. An image forming apparatus for forming a toner image on a photoconductive element with charging means exposing means and developing means, and transferring said toner image to a recording medium, said apparatus comprising:

calculating means for calculating a state amount relating to a developing characteristic of said developing means acting on said image carrier;

aging executing means for executing at least one of agitation of a developer stored in said developing means, replenishment of toner to said developing means and consumption of toner by said developing means;

control means for controlling said aging executing means such that said state amount calculated by said calculating means coincides with a desired state amount; and image forming condition varying means for varying an image forming condition assigned to usual image formation at a desired timing such that a desired image is produced:

wherein said image forming condition varying means calculates, after aging of the developer, an image forming condition for usual image formation, controls a potential in order to set up said image forming condition, and uses a resulting controlled potential for subsequent image formation.

30. An apparatus as claimed in claim 29, wherein said developing means comprises a plurality of developing sections, and said apparatus further includes means for setting a different desired state amount for each developing section of said plurality of developing sections.

31. An image forming apparatus including developing means, comprising:

surface potential measuring means for measuring a surface potential of a reference latent image pattern formed on an image carrier;

toner deposition measuring means for measuring an amount of toner existing on a toner pattern produced by developing said reference latent image pattern;

calculating means for calculating a state amount relating to a developing characteristic on the basis of said surface potential and said amount of toner;

aging executing means for executing at least one of agitation of a developer stored in said developing means, replenishment of toner to said developing means and toner consumption by said developing means in an interruptible manner; and control means for controlling said aging executing means such that said state amount calculated coincides with a desired state amount.

32. An apparatus as claimed in claim 31, further comprising environment sensing means for sensing an environment when said calculating means calculates said state amount.

33. An apparatus as claimed in claim 32, wherein said developing means comprises a plurality of developing sections, and said apparatus further includes means for setting a different desired state amount for each developing section of said plurality of developing sections.

34. An apparatus as claimed in claim 32, further comprising image forming condition varying means for varying an image forming condition assigned to usual image formation at a desired timing such that a desired image is produced.

35. An apparatus as claimed in claim 34, wherein said developing means comprises a plurality of developing sections, and said apparatus further includes means for setting a different desired state amount for each developing section of said plurality of developing sections.

36. An apparatus as claimed in claim 34, wherein said image forming condition varying means calculates, after aging of the developer, an image forming condition for usual image formation, controls a potential in order to set up said image forming condition, and uses a resulting controlled potential for subsequent image formation.

37. An apparatus as claimed in claim 36, wherein said developing means comprises a plurality of developing sections, and said apparatus further includes means for setting a different desired state amount for each developing section of said plurality of developing sections.

38. An apparatus as claimed in claim 31, wherein said state amount relating to the developing characteristic comprises a maximum amount of toner deposition implementing image formation, said control means driving said aging executing means until said maximum amount lies in a range above an amount implementing a target image.

39. An apparatus as claimed in claim 38, wherein said developing means comprises a plurality of developing sections, and said apparatus further includes means for setting a different desired state amount for each developing section of said plurality of developing sections.

40. An apparatus as claimed in claim 38, further comprising image forming condition varying means for varying an image forming condition assigned to usual image formation at a desired timing such that a desired image is produced.

41. An apparatus as claimed in claim 40, wherein said developing means comprises a plurality of developing sections, and said apparatus further includes means for setting a different desired state amount for each developing section of said plurality of developing sections.

42. An apparatus as claimed in claim 40, wherein said image forming condition varying means calculates, after aging of the developer, an image forming condition for usual image formation, controls a potential, in order to set up said image forming condition, and uses a resulting controlled potential for subsequent image formation.

43. An apparatus as claimed in claim 42, wherein said developing means comprises a plurality of developing sections, and said apparatus further includes means for setting a different desired state amount for each developing section of said plurality of developing sections.

44. An apparatus as claimed in claim 31, wherein said state amount relating to the developing characteristic comprises development $\gamma$ derived from a plurality of reference patterns, said control means driving said aging executing means until said development $\gamma$ lies in a preselected range of target development $\gamma$.

45. An apparatus as claimed in claim 44, wherein said developing means comprises a plurality of developing sections, and said apparatus further includes means for setting a different desired state amount for each developing section of said plurality of developing sections.

46. An apparatus as claimed in claim 44, further comprising image forming condition varying means for varying an image forming condition assigned to usual image formation at a desired timing such that a desired image is produced.

47. An apparatus as claimed in claim 46, wherein said developing means comprises a plurality of developing sections, and said apparatus further includes means for setting a different desired state amount for each developing section of said plurality of developing sections.

48. An apparatus as claimed in claim 46, wherein said image forming condition varying means calculates, after aging of the developer, an image forming condition for usual image formation, controls a potential in order to set up said image forming condition, and uses a resulting controlled potential for subsequent image formation.

49. An apparatus as claimed in claim 48, wherein said developing means comprises a plurality of developing sections, and said apparatus further includes means for setting a different desired state amount for each developing section of said plurality of developing sections.

50. An apparatus as claimed in claim 31, wherein said state amount relating to the developing characteristic comprises a development start voltage derived from a plurality of reference patterns, said control means driving said aging executing means such that said development start voltage lies in a preselected range of a target development start voltage.

51. An apparatus as claimed in claim 50, wherein said developing means comprises a plurality of developing sections, and said apparatus further includes means for setting a different desired state amount for each developing section of said plurality of developing sections.

52. An apparatus as claimed in claim 50, further comprising image forming condition varying means for varying an image forming condition assigned to usual image formation at a desired timing such that a desired image is produced.

53. An apparatus as claimed in claim 52, wherein said developing means comprises a plurality of developing sections, and said apparatus further includes means for setting a different desired state amount for each developing section of said plurality of developing sections.

54. An apparatus as claimed in claim 52, wherein said image forming condition varying means calculates, after aging of the developer, an image forming condition for usual image formation, controls a potential in order to set up said image forming condition, and uses a resulting controlled potential for subsequent image formation.

55. An apparatus as claimed in claim 54, wherein said developing means comprises a plurality of developing sections, and said apparatus further includes means for setting a different desired state amount for each developing section of said plurality of developing sections.

56. An apparatus as claimed in claim 31, further comprising image forming condition varying means for varying an image forming condition assigned to usual image formation at a desired timing such that a desired image is produced.

57. An apparatus as claimed in claim 56, wherein said developing means comprises a plurality of developing sections, and said apparatus further includes means for setting a different desired state amount for each developing section of said plurality of developing sections.

58. An apparatus as claimed in claim 56, wherein said image forming condition varying means calculates, after aging of the developer, an image forming condition for usual image formation, controls a potential in order to set up said image forming condition, and uses a resulting controlled potential for subsequent image formation.

59. An apparatus as claimed in claim 31, wherein said developing means comprises a plurality of developing sections, and said apparatus further includes means for setting a different desired state amount for each developing section of said plurality of developing sections.

60. An automatic developer aging method for an image forming apparatus, comprising the steps of:

forming a reference latent image pattern on an image carrier, and measuring a surface potential of said reference latent image pattern;

developing said reference latent image pattern by toner, and measuring an amount of the toner deposited on said reference latent image pattern;

calculating, based on said surface potential and said amount of toner, an instantaneous state amount relating to a developing characteristic; and executing aging of a developer on the basis of said state amount such that a desired developing characteristic is set up.

61. A method as claimed in claim 60, wherein said aging is executed stepwise such that a condition assigned to usual image formation is set up at a final step.

62. A method as claimed in claim 61, further comprising detecting an environmental condition when said state amount relating to the developing characteristic is to be calculated.

63. A method as claimed in claim 61, wherein said state amount relating to the developing characteristic comprises a state amount at the time of toner replenishment control to be executed during said aging.

64. A method as claimed in claim 61, wherein said state amount relating to the developing characteristic comprises a potential for developing a latent image pattern assigned to toner replenishment control to be executed during said aging.

65. A method as claimed in claim 61, wherein said state amount relating to the developing characteristic comprises a state amount particular to selection of an internal pattern stored in said apparatus and consuming a different amount of toner during said aging.

66. A method as claimed in claim 65, wherein the selection of said internal pattern is such that a pattern consuming much toner is selected when a developing ability is higher than a target ability, or a pattern consuming little toner is selected when the developing ability is lower than the target ability.

67. A method as claimed in claim 65, wherein the selection of said internal pattern is such that a pattern consuming little toner is selected when contamination of a background of an image carrier is noticeable.

68. A method as claimed in claim 61, wherein said state amount relating to the developing characteristic comprises a maximum amount of toner deposition implementing image formation, said aging being executed until said maximum amount of toner deposition lies in a range above an amount implementing target image formation.

69. A method as claimed in claim 61, wherein said state amount relating to the developing characteristic comprises development $\gamma$ derived from a plurality of reference patterns, said aging being executed until said development $\gamma$ lies in a preselected range of a target development $\gamma$.

70. A method as claimed in claim 61, wherein said state amount relating to the developing characteristic comprises a development start voltage derived from a plurality of reference patterns, said aging being executed until said development start voltage lies in a preselected range of a target development start voltage.

71. A method as claimed in claim 61, wherein a mode is provided in which the toner is consumed without any replenishment during said aging until a preselected amount of toner deposition has been set up.

72. A method as claimed in claim 61, wherein a toner replenishing condition is automatically switched at least once during said aging.

73. A method as claimed in claim 61, wherein a toner replenishing condition is set after said aging.

74. A method as claimed in claim 61, wherein in a revolver type developing device said aging is executed by causing said revolver type developing device to make at least one revolution after replenishment of the toner.

75. A method as claimed in claim 62, wherein said state amount relating to the developing characteristic comprises a potential for developing a latent image pattern assigned to toner replenishment control to be executed during said aging.

76. A method as claimed in claim 62, wherein said state amount relating to the developing characteristic comprises a state amount particular to selection of an internal pattern stored in said apparatus and consuming a different amount of toner during said aging.

77. A method as claimed in claim 76, wherein the selection of said internal pattern is such that a pattern consuming much toner is selected when a developing ability is higher than a target ability, or a pattern consuming little toner is selected when the developing ability is lower than the target ability.

78. A method as claimed in claim 76, wherein the selection of said internal pattern is such that a pattern consuming little toner is selected when contamination of a background of an image carrier is noticeable.

79. A method as claimed in claim 62, wherein said state amount relating to the developing characteristic comprises a maximum amount of toner deposition implementing image formation, said aging being executed until said maximum amount of toner deposition lies in a range above an amount implementing target image formation.

80. A method as claimed in claim 62, wherein said state amount relating to the developing characteristic comprises development $\gamma$ derived from a plurality of reference patterns, said aging being executed until said development $\gamma$ lies in a preselected range of a target development $\gamma$.

81. A method as claimed in claim 62, wherein said state amount relating to the developing characteristic comprises a development start voltage derived from a plurality of reference patterns, said aging being executed until said development start voltage lies in a preselected range of a target development start voltage.

82. A method as claimed in claim 62, wherein a mode is provided in which the toner is consumed without any replenishment during said aging until a preselected amount of toner deposition has been set up.

83. A method as claimed in claim 62, wherein a toner replenishing condition is automatically switched at least once during said aging.

84. A method as claimed in claim 62, wherein a toner replenishing condition is set after said aging.

85. A method as claimed in claim 62, wherein in a revolver type developing device said aging is executed by causing said revolver type developing device to make at least one revolution after replenishment of the toner.

86. A method as claimed in claim 60, further comprising detecting an environmental condition when said state amount relating to the developing characteristic is to be calculated.

87. A method as claimed in claim 60, wherein said state amount relating to the developing characteristic comprises a state amount at the time of toner replenishment control to be executed during said aging.

88. A method as claimed in claim 60, wherein said state amount relating to the developing characteristic comprises a potential for developing a latent image pattern assigned to toner replenishment control to be executed during said aging.

89. A method as claimed in claim 60, wherein said state amount relating to the developing characteristic comprises a state amount particular to selection of an internal pattern stored in said apparatus and consuming a different amount of toner during said aging.

90. A method as claimed in claim 89, wherein the selection of said internal pattern is such that a pattern consuming much toner is selected when a developing ability is higher than a target ability, or a pattern consuming little toner is selected when the developing ability is lower than the target ability.

91. A method as claimed in claim 89, wherein the selection of said internal pattern is such that a pattern consuming little toner is selected when contamination of a background of an image carrier is noticeable.

92. A method as claimed in claim 60, wherein said state amount relating to the developing characteristic comprises a maximum amount of toner deposition implementing image formation, said aging being executed until said maximum amount of toner deposition lies in a range above an amount implementing target image formation.

93. A method as claimed in claim 61, wherein said state amount relating to the developing characteristic comprises development $\gamma$ derived from a plurality of reference patterns, said aging being executed until said development $\gamma$ lies in a preselected range of a target development $\gamma$.

94. A method as claimed in claim 60, wherein said state amount relating to the developing characteristic comprises a development start voltage derived from a plurality of reference patterns, said aging being executed until said development start voltage lies in a preselected range of a target development start voltage.

95. A method as claimed in claim 60, wherein a mode is provided in which the toner is consumed without any replenishment during said aging until a preselected amount of toner deposition has been set up.

96. A method as claimed in claim 60, wherein a toner replenishing condition is automatically switched at least once during said aging.

97. A method as claimed in claim 60, wherein a toner replenishing condition is set after said aging.

98. A method as claimed in claim 60, wherein in a revolver type developing device said aging is executed by causing said revolver type developing device to make at least one revolution after replenishment of the toner.

99. A method as claimed in claim 86, wherein said state amount relating to the developing characteristic comprises a state amount at the time of toner replenishment control to be executed during said aging.

100. A method as claimed in claim 86, wherein said state amount relating to the developing characteristic comprises a potential for developing a latent image pattern assigned to toner replenishment control to be executed during said aging.

101. A method as claimed in claim 86, wherein said state amount relating to the developing characteristic comprises a state amount particular to selection of an internal pattern stored in said apparatus and consuming a different amount of toner during said aging.

102. A method as claimed in claim 101, wherein the selection of said internal pattern is such that a pattern consuming much toner is selected when a developing ability is higher than a target ability, or a pattern consuming little toner is selected when the developing ability is lower than the target ability.

103. A method as claimed in claim 101, wherein the selection of said internal pattern is such that a pattern consuming little toner is selected when contamination of a background of an image carrier is noticeable.

104. A method as claimed in claim 86, wherein said state amount relating to the developing characteristic comprises a maximum amount of toner deposition implementing image formation, said aging being executed until said maximum amount of toner deposition lies in a range above an amount implementing target image formation.

105. A method as claimed in claim 86, wherein said state amount relating to the developing characteristic comprises development $\gamma$ derived from a plurality of reference patterns, said aging being executed until said development $\gamma$ lies in a preselected range of a target development $\gamma$.

106. A method as claimed in claim 86, wherein said state amount relating to the developing characteristic comprises a development start voltage derived from a plurality of reference patterns, said aging being executed until said development start voltage lies in a preselected range of a target development start voltage.

107. A method as claimed in claim 86, wherein a mode is provided in which the toner is consumed without any replenishment during said aging until a preselected amount of toner deposition has been set up.

108. A method as claimed in claim 86, wherein a toner replenishing condition is automatically switched at least once during said aging.

109. A method as claimed in claim 86, wherein a toner replenishing condition is set after said aging.

110. A method as claimed in claim 86, wherein in a revolver type developing device said aging is executed by causing said revolver type developing device to make at least one revolution after replenishment of the toner.

111. An image forming apparatus including developing means, comprising:

surface potential measuring means for measuring a surface potential of a reference latent image pattern formed on an image carrier;

toner deposition measuring means for measuring an amount of toner existing on a toner pattern produced by developing said reference latent image pattern;

calculating means for calculating a state amount relating to a developing characteristic on the basis of said surface potential and said amount of toner;

aging executing means for executing at least one of agitation of a developer stored in said developing means, replenishment of toner to said developing means and toner consumption by said developing means; and control means for controlling said aging executing means such that said state amount calculated coincides with a desired state amount.

112. An image forming apparatus comprising:

forming means for forming a reference latent image on an image carrier, and measuring a surface potential of said reference image pattern;

developing means for developing said reference latent image pattern by toner, and measuring an amount of the toner deposited on said reference latent image pattern;

calculating means for calculating, based on said surface potential and said amount of toner, an instantaneous state amount relating to a developing characteristic; and executing means for executing aging of a developer on the basis of said state amount such that a desired developing characteristic is set up, a toner replenishing condition being set after said aging.

113. An apparatus as claimed in claim 112, wherein said toner replenishing condition comprises an image forming condition of the reference latent image pattern.

* * * * *